US008754779B2

(12) United States Patent
Ruther et al.

(10) Patent No.: US 8,754,779 B2
(45) Date of Patent: Jun. 17, 2014

(54) SYSTEM AND METHOD FOR DISPLAYING INPUT DATA ON A REMOTE DISPLAY DEVICE

(75) Inventors: Timothy G. Ruther, Carpentersville, IL (US); Ronald A. Lattanzi, Hawthorn Woods, IL (US)

(73) Assignee: Snap-on Incorporated, Kenosha, WI (US)

( * ) Notice: Subject to any disclaimer, the term of this patent is extended or adjusted under 35 U.S.C. 154(b) by 538 days.

(21) Appl. No.: 13/198,974

(22) Filed: Aug. 5, 2011

(65) Prior Publication Data

US 2012/0044086 A1 Feb. 23, 2012

Related U.S. Application Data

(60) Provisional application No. 61/374,825, filed on Aug. 18, 2010.

(51) Int. Cl.
*G08B 23/00* (2006.01)

(52) U.S. Cl.
USPC ..... 340/870.02; 340/870.01; 340/870.03; 345/672; 345/204; 345/48; 348/14.04; 348/14.05; 348/14.06; 348/14.07; 348/43; 725/62; 725/67; 725/68

(58) Field of Classification Search
USPC ..... 340/870.02, 870.01, 870.03; 345/672, 345/204, 48, 63; 370/349, 386, 391, 240; 348/14.04, 14.05, 14.06, 14.07, 43; 725/62, 67, 68
See application file for complete search history.

(56) References Cited

U.S. PATENT DOCUMENTS 4,113,980 A 9/1978 Bell
4,270,174 A 5/1981 Karlin et al.
(Continued)

FOREIGN PATENT DOCUMENTS

CA 2373157 A1 3/2000
DE 195 43 784 A1 5/2007
(Continued)

OTHER PUBLICATIONS

Bluetooth SIG Inc., Bluetooth Specification Version 4.0, vol. 2, "Core System Package [BR/EDR Controller volume]," Part C "Link Manager Protocol Specification," Section 4.2 "Security", pp. 247-275, Jun. 30, 2010.

(Continued)

*Primary Examiner* — Hoi Lau
(74) *Attorney, Agent, or Firm* — McDonnell Boehnen Hulbert & Berghoff LLP

(57) ABSTRACT

A system comprising multiple devices that are operable when servicing a device-under service is described. A DAQ device is operable to generate input data from input signals received from the device-under-service and to transmit the input data to a display device via a wireless network. The DAQ device comprises multiple buffers to store the input data. One of the buffers stores two frames of the input data, which can be live input data or historical input data. At any one time, a display at the display device visually presents one frame of input data for each respective input channel of the DAQ device. At any one time, a display at the DAQ device visually presents a half-frame of input data for each respective input channel of the DAQ device. Another buffer at the DAQ device can store more than two frames of input data including historical input data.

24 Claims, 17 Drawing Sheets

(56) References Cited

U.S. PATENT DOCUMENTS 4,404,639 A 9/1983 McQuire et al.
4,441,359 A 4/1984 Ezoe
4,602,127 A 7/1986 Neely et al.
4,814,896 A * 3/1989 Heitzman et al. ..... 386/239
4,853,850 A 8/1989 Krass, Jr. et al.
4,962,456 A 10/1990 Abe et al.
5,157,610 A 10/1992 Asano et al.
5,160,892 A 11/1992 Makhija et al.
5,317,304 A 5/1994 Choi
5,365,436 A 11/1994 Schaller et al.
5,373,458 A 12/1994 Bishay et al.
5,396,168 A 3/1995 Heep et al.
5,432,904 A 7/1995 Wong
5,442,553 A 8/1995 Parrillo
5,465,207 A 11/1995 Boatwright et al.
5,506,772 A 4/1996 Kubozono et al.
5,521,443 A 5/1996 Imura et al.
5,532,927 A 7/1996 Pink et al.
5,541,840 A 7/1996 Gurne et al.
5,583,912 A 12/1996 Schillaci et al.
5,592,383 A 1/1997 Rogers et al.
5,758,300 A 5/1998 Abe
5,766,020 A 6/1998 Hughes
5,850,209 A 12/1998 Lemke et al.
5,884,202 A 3/1999 Arjomand
5,899,947 A 5/1999 Hall et al.
5,923,161 A 7/1999 Frankovitch, Jr. et al.
6,021,366 A 2/2000 Fieramosca et al.
6,055,468 A 4/2000 Kaman et al.
6,067,486 A 5/2000 Aragones et al.
6,094,609 A 7/2000 Arjomand
6,134,489 A 10/2000 Smedley
6,140,811 A 10/2000 Little
6,169,943 B1 1/2001 Simon et al.
6,178,527 B1 1/2001 Vidales
6,179,214 B1 1/2001 Key et al.
6,181,563 B1 1/2001 Shimbo et al.
6,188,384 B1 2/2001 Sullivan et al.
6,192,303 B1 2/2001 Takakura et al.
6,222,374 B1 4/2001 Shoemaker
6,294,982 B1 9/2001 Hooks et al.
6,314,422 B1 11/2001 Barker et al.
6,321,151 B1 11/2001 Shultz
6,356,823 B1 3/2002 Iannotti et al.
6,360,551 B1 3/2002 Renders
6,374,315 B1 4/2002 Okada et al.
6,385,300 B1 5/2002 Mohammadian et al.
6,401,049 B1 6/2002 Ehmer
6,477,478 B1 11/2002 Jones et al.
6,487,478 B1 11/2002 Azzaro et al.
6,609,050 B2 8/2003 Li
6,622,070 B1 9/2003 Wacker et al.
6,640,166 B2 10/2003 Liebl et al.
6,662,123 B2 12/2003 Maeckel et al.
6,693,367 B1 2/2004 Schmeisser et al.
6,711,524 B2 3/2004 Wolf et al.
6,745,151 B2 6/2004 Marko et al.
6,757,521 B1 6/2004 Ying
6,778,931 B1 8/2004 Letts et al.
6,789,007 B2 9/2004 Ellis et al.
6,802,032 B1 10/2004 Budinger et al.
6,807,469 B2 10/2004 Funkhouser et al.
6,822,639 B1 11/2004 Silverbrook et al.
6,823,243 B2 11/2004 Chinnadurai et al.
6,844,823 B2 1/2005 Hooks et al.
6,847,916 B1 1/2005 Ying
6,873,940 B1 3/2005 Kamatani
6,947,043 B1 9/2005 Klingman et al.
6,957,128 B1 10/2005 Ito et al.
6,959,235 B1 10/2005 Abdel-Malek et al.
6,972,669 B2 12/2005 Saito et al.
6,982,653 B2 1/2006 Voeller et al.
6,988,053 B2 1/2006 Namaky
7,020,546 B2 3/2006 Nagai et al.
7,023,332 B2 4/2006 Saito et al.
7,073,714 B2 7/2006 Namaky et al.
7,124,058 B2 10/2006 Namaky et al.
7,155,321 B2 12/2006 Bromley et al.
7,200,483 B1 4/2007 Kavadeles
7,224,262 B2 5/2007 Simon et al.
7,251,552 B2 7/2007 Schmeisser et al.
7,254,550 B2 8/2007 Reichwein et al.
7,269,482 B1 9/2007 Shultz et al.
7,272,476 B2 9/2007 Ortiz et al.
7,281,663 B2 10/2007 Schmidt et al.
7,294,906 B2 11/2007 Ukaji
7,327,228 B2 2/2008 Min et al.
7,336,082 B1 2/2008 Mofield et al.
7,363,129 B1 4/2008 Barnicle et al.
7,383,318 B2 6/2008 Craik
7,444,216 B2 10/2008 Rogers et al.
7,504,926 B2 3/2009 Bessho et al.
7,535,466 B2 * 5/2009 Sampsell et al. ..... 345/204
7,580,781 B2 8/2009 Mindeman
7,613,554 B2 11/2009 Rollinger et al.
7,634,337 B2 12/2009 Brozovich et al.
7,648,062 B2 1/2010 Corniot
7,702,437 B2 4/2010 Gilbert
7,711,462 B2 5/2010 Daniels et al.
7,751,955 B2 7/2010 Chinnadurai et al.
8,670,437 B2 * 3/2014 Walker et al. ..... 370/349
2001/0001850 A1 5/2001 Miller
2002/0040261 A1 4/2002 Nakamoto et al.
2002/0077780 A1 6/2002 Liebl et al.
2003/0020759 A1 1/2003 Cancilla et al.
2003/0034767 A1 2/2003 Lipscomb et al.
2003/0036832 A1 2/2003 Kokes et al.
2003/0058243 A1 3/2003 Faust et al.
2003/0088346 A1 5/2003 Calkins et al.
2003/0122671 A1 7/2003 Jespersen
2003/0222873 A1 12/2003 Ritter
2004/0054503 A1 3/2004 Namaky
2004/0172177 A1 9/2004 Nagai et al.
2005/0083965 A1 4/2005 Sodergren
2005/0094588 A1 5/2005 Wentink
2005/0152294 A1 7/2005 Yu et al.
2005/0157732 A1 7/2005 Joy et al.
2005/0182537 A1 8/2005 Tefft et al.
2005/0267655 A1 12/2005 Gessner
2006/0025897 A1 2/2006 Shostak et al.
2006/0036355 A1 2/2006 Schaar et al.
2006/0062190 A1 3/2006 Suga
2006/0066504 A1 * 3/2006 Sampsell et al. ..... 345/1.1
2006/0078175 A1 4/2006 Brozovich
2006/0101311 A1 5/2006 Lipscomb et al.
2006/0106508 A1 5/2006 Liebl et al.
2006/0149434 A1 7/2006 Bertosa et al.
2006/0180371 A1 8/2006 Breed et al.
2006/0199537 A1 9/2006 Eisenbach
2006/0212239 A1 9/2006 Letts et al.
2006/0212540 A1 9/2006 Chon et al.
2006/0226298 A1 10/2006 Pierson
2007/0010922 A1 1/2007 Buckley
2007/0043488 A1 2/2007 Avery et al.
2007/0072154 A1 * 3/2007 Akatsuka et al. ..... 434/69
2007/0073459 A1 3/2007 Webster et al.
2007/0073460 A1 3/2007 Bertosa et al.
2007/0083307 A1 4/2007 Pasztor et al.
2007/0100520 A1 5/2007 Shah et al.
2007/0146133 A1 6/2007 Wehrenberg
2007/0156311 A1 7/2007 Elcock et al.
2007/0156313 A1 7/2007 Fudali et al.
2007/0200550 A1 8/2007 Corredoura
2007/0244611 A1 10/2007 Brozovich
2007/0244614 A1 10/2007 Nathanson
2007/0288134 A1 12/2007 Rollinger et al.
2007/0290847 A1 12/2007 Harrington et al.
2007/0294556 A1 12/2007 Wutka
2008/0003997 A1 1/2008 Parkkinen et al.
2008/0015748 A1 1/2008 Nagy
2008/0033609 A1 2/2008 Razavi
2008/0070501 A1 3/2008 Wyld
2008/0076389 A1 3/2008 Lee et al.
2008/0082221 A1 4/2008 Nagy

(56) References Cited

U.S. PATENT DOCUMENTS

| | | | | |
|---|---|---|---|---|
| 2008/0082278 | A1 | 4/2008 | Tan et al. | |
| 2008/0103658 | A1 | 5/2008 | Boac et al. | |
| 2008/0122288 | A1 | 5/2008 | Plante et al. | |
| 2008/0125067 | A1 | 5/2008 | Bells et al. | |
| 2008/0140281 | A1 | 6/2008 | Morris et al. | |
| 2008/0228344 | A1 | 9/2008 | Sampson et al. | |
| 2008/0248748 | A1 | 10/2008 | Sangster et al. | |
| 2008/0285659 | A1 | 11/2008 | Raines et al. | |
| 2008/0319665 | A1 | 12/2008 | Berkobin et al. | |
| 2009/0125351 | A1 | 5/2009 | Davis, Jr. | |
| 2009/0150970 | A1 | 6/2009 | Hinds et al. | |
| 2009/0259349 | A1 | 10/2009 | Golenski | |
| 2009/0265057 | A1 | 10/2009 | Chinnadurai et al. | |
| 2009/0276115 | A1 | 11/2009 | Chen | |
| 2009/0288009 | A1 | 11/2009 | Dulaney | |
| 2009/0299539 | A1 | 12/2009 | Chinnadurai et al. | |
| 2009/0307188 | A1 | 12/2009 | Oldham et al. | |
| 2010/0042288 | A1 | 2/2010 | Lipscomb et al. | |
| 2010/0076644 | A1 | 3/2010 | Cahill et al. | |
| 2010/0100646 | A1 | 4/2010 | Park | |
| 2010/0128632 | A1 | 5/2010 | Mantysalo | |
| 2010/0205450 | A1 | 8/2010 | Sarnacke et al. | |
| 2010/0289872 | A1* | 11/2010 | Funabiki et al. | 348/43 |
| 2011/0141953 | A1 | 6/2011 | Wright et al. | |
| 2011/0153798 | A1 | 6/2011 | Groenendaal et al. | |
| 2011/0313593 | A1 | 12/2011 | Cohen et al. | |
| 2012/0044052 | A1 | 2/2012 | Davis et al. | |
| 2012/0044086 | A1 | 2/2012 | Ruther et al. | |
| 2012/0044527 | A1 | 2/2012 | Panko | |
| 2012/0044607 | A1 | 2/2012 | Loewe | |
| 2012/0045927 | A1 | 2/2012 | Panko et al. | |
| 2012/0046807 | A1 | 2/2012 | Ruther et al. | |
| 2012/0046824 | A1 | 2/2012 | Ruther et al. | |
| 2012/0046825 | A1 | 2/2012 | Ruther et al. | |
| 2012/0046826 | A1 | 2/2012 | Panko | |
| 2012/0046897 | A1 | 2/2012 | Panko | |
| 2012/0047289 | A1 | 2/2012 | Krzystofczyk et al. | |
| 2012/0047291 | A1 | 2/2012 | Davis et al. | |
| 2012/0047458 | A1 | 2/2012 | Alberry et al. | |
| 2012/0047499 | A1 | 2/2012 | Krzystofczyk et al. | |
| 2012/0139952 | A1* | 6/2012 | Imai et al. | 345/672 |
| 2012/0242510 | A1* | 9/2012 | Choi et al. | 340/988 |

FOREIGN PATENT DOCUMENTS

| | | | |
|---|---|---|---|
| DE | 20 2009 009 035 | U1 | 10/2009 |
| GB | 2277807 | A | 11/1994 |
| GB | 2385934 | A | 9/2003 |
| GB | 2405486 | A | 3/2005 |
| JP | 2008233970 | A | 10/2008 |
| WO | 9956201 | A1 | 11/1999 |
| WO | 00/34838 | A1 | 6/2000 |
| WO | 01/59601 | A1 | 8/2001 |
| WO | 0155690 | A1 | 8/2001 |
| WO | 0167420 | A1 | 9/2001 |
| WO | 0186576 | A1 | 11/2001 |
| WO | 2005121814 | A1 | 12/2005 |
| WO | 2006008527 | A2 | 1/2006 |
| WO | 2006/050454 | A2 | 5/2006 |
| WO | 2006055289 | A2 | 5/2006 |
| WO | 2006110786 | A2 | 10/2006 |
| WO | 2007022426 | A2 | 2/2007 |
| WO | 2007038983 | A1 | 4/2007 |
| WO | 2007058607 | A1 | 5/2007 |
| WO | 2008/043043 | A2 | 4/2008 |
| WO | 2008063818 | A2 | 5/2008 |
| WO | 2009137584 | A1 | 11/2009 |
| WO | 2009149007 | A1 | 12/2009 |
| WO | 2010019771 | A1 | 2/2010 |

OTHER PUBLICATIONS

Engineer Live, "Ethernet makes it way into the car," Article date: Jun. 9, 2009, downloaded from the World Wide Web at http://www.engineerlive.com/Design-Engineer/Automotive_Design/Ethernet_makes_its_way_into_the_car/21822/ on Jul. 25, 2011, 4 pages.

OBD-II PIDs, downloaded from the World Wide Web at http://web.archive.org/web/20100329141311/http://en.wikipedia.org/wiki/OBD-II_PIDs, as available on Mar. 9, 2010, 13 pages.

Sorion Electronic Limited, J1962—OBD Diagnostics Connectors, downloaded from World Wide Web at http://www.sorion-group.com/SEL0051_connector.htm on May 24, 2010, pp. 1-3.

Memopad, The OBD2 Cable for Allpro adapter, downloaded from the World Wide Web at http://datawave.oommm.com/entry/USB-OBD2-AllPro-adapter, pp. 1-16, Oct. 8, 2008.

Tyco Electronics, Fundamentals of PolySwitch Overcurrent and Overtemperature Devices, pp. 1-13, Sep. 2, 2009.

International Organization for Standardization, ISO TC 22/SC 3, ISO 15031-1:2001(E), Road vehicles—Communication between vehicle and external test equipment for emissions-related diagnostics—Part 1: General information, 36 pages, Aug. 5, 2001.

International Organization for Standardization, ISO TC 22/SC 3 N, ISO/CD 22900-2, Road vehicles, Modular VCI (Vehicle Communication Interface)—Part 2: D-PDU API (Diagnostic Protocol Data Unit Application Programmer Interface), 144 pages, Mar. 31, 2005.

International Organization for Standardization, ISO TC 22/SC 3 N, ISO/CD 22900-1, Road vehicles—Modular Vehicle Communication Interface (MVCI)—Part 1: Hardware design requirements, 29 pages, Mar. 31, 2005.

International Organization for Standardization, ISO TC 22/SC 3 N, ISO/CD 22900-1, Road vehicles—Modular Vehicle Communication Interface (MVCI)—Part 3: D-Server API (Diagnostic Server Application Programmer Interface), 159 pages, Mar. 31, 2005.

International Organization for Standardization, ISO 15031-3:2400(E), Road vehicles—Communication between vehicle and external equipment for emissions-related diagnostics—Part 3: Diagnostic connector and related electrical circuits, specification and use—Annex B pp. 17-18, Jul. 2004.

Vital Engineering, Support and Frequently Asked Question regarding the Car-Pal OBD Interface Unit, Jan. 4, 2007, downloaded from the World Wide Web at http://www.vitalengineering.co.uk/support.htm, 8 pages.

Tech Shop Magazine; Snap-on Introduces VERDICT Diagnostic and Information System; Aug. 26, 2010; downloaded from the World Wide Web at http://www.techshopmag.com/Controls/PrinterFriendly/PrinterFriendly.aspx, 3 pages.

Snap-on Incorporated, MODIS, Scanner Plug-in User Manual, ZEEMS303L, Rev. A, Aug. 2009, 61 pages.

Snap-on Incorporated, MODIS, Display User Manual, ZEEMS300N, Rev. A, Aug. 2009, 72 pages.

Snap-on Incorporated, MODIS, Component Tests User Manual, ZEEMS308G, Rev. C, Feb. 2009, 52 pages.

Snap-on Incorporated, MODIS, Flexible Gas Analyzer User Manual, ZEEMS306B, Rev. A, Aug. 2009, 47 pages.

Snap-on Incorporated, MODIS, Lab Scope Plug-in User Manual, ZEEMS305K, Rev. C, Feb. 2009, 73 pages.

Metzelaar, R.H.M., Automotive Oscilloscope Applications, Peugeot 205 Holding Back, downloaded from the World Wide Web at http://www.tiepie.com/uk/automotive/GMT/peugeot_205_holding_back.html on Jul. 12, 2010, pp. 1-4.

Zussman, Gil et al, Bluetooth Time Division Duplex Analysis as a Polling System, Aug. 19, 2004.

Fluke Corporation, Digital Multimeters, downloaded from the World Wide Web at http://us.fluke.com/usen/products/categorydmm on Jan. 28, 2010.

Fluke Corportation, 233 True=rms Remote Display Digital Multimeter Users Manual, Sep. 2009.

Bluetooth SIG, Inc., Bluetooth Architecture—Data Transport, downloaded from the World Wide Web at http://www.bluetooth.com/KnowledgeCenter/TechnologyOverview/Pages/DataTransport.aspx on May 6, 2010.

Shigeru et al, DL7100 Signal Explorer, A High-Speed Digital Oscilloscope with Long Record Length, Yokogawa Electric Corporation, Yogogawa Technical Report English Edition, No. 30, (2000).

bluetomorrow.com, Bluetooth Pairing, downloaded from the World Wide Web at www.bluetomorrow.com on Apr. 30, 2010.

Snap-on Diagnostics, Snap-on Introduces VERDICTt Diagnostic and Information System, Aug. 24, 2010.

(56) References Cited

OTHER PUBLICATIONS

Testpath, Inc., Fluke Meter Holsters, downloaded from the World Wide Web at http://www.testpath.com/Categories/Fluke-Meter-Holsters-2220.htm on May 6, 2010.
BMW Canada, Bluetooth Pairing Instructions, Sep. 2009.
Accessory Geeks, Bluetooth Pairing Guides, downloaded from the World Wide Web at http://www.accessorygeeks.com/bluetooth-pairing-guide1.html on Apr. 30, 2010.
Quatech, Inc., Bluetooth Communication Overview, downloaded from the World Wide Web at http://www.quatech.com/support/comm-over-bluetooth.php on May 3, 2010.
Omitec Limited, T4 Diagnostic System, downloaded from the World Wide Web at http://web.archive.org/web/20091119041838/http://www.omitec.com/us/products/diagnostic-testers/t4-diagnostic-system/ as archived on Nov. 19, 2009.
Omitec Limited, Workstations, downloaded from the World Wide Web at http://web.archive.org/web/20100322213801/http://www.omitec.com/us/products/workstation/ as archived on Mar. 22, 2010.
anotherurl.com, Bluetooth, What is Bluetooth? downloaded from the World Wide Web at http://www.anotherurl.com/library/bluetooth_research.htm on May 17, 2010.veridict.
Snap-on Incorporated, EEDM604C, Multimeter, Digital, Automotive, True RMS, Auto Ranging, Hybrid Vehicles, downloaded from the World Wide Web at http://buy1.snapon.com/catalog/item.asp?store=snapon-store&item_ID=88136&group_ID=1367 on May 4, 2010.
Snap-on Incorporated, EEDM596DK, Multimeter, Digital, Advanced, Manual Ranging, downloaded from the World Wide Web at http://buy1.snapon.com/catalog/item.asp?store=snapon-store&item_ID=84657&group_ID=1367 on May 4, 2010.
Snap-on Incorporated, EEDM503D, Multimeter, Digital, Automotive, True RMS, downloaded from the World Wide Web at http://buy1.snapon.com/catalog/item.asp?store=snapon-store&item_ID=84656&group_ID=1367 on May 4, 2010.
Fluke, 163/164 MultiFunction Counter Users Manual, Feb. 1, 1997.
Fluke, Fluke 164 2.7 GHz Multifunction Counter Technical Data, May 10, 2007.
Report Lab, OBD-II PIDS, Jul. 6, 2010.
Flores, J., Wireless Diagnostics and Consultancy Services, Vital Engineering, Jan. 4, 2007.
Fluke, Fluke 199B / 003 Scopemeter 200 MHz, Dual Portable Multimeter and Oscilloscope, downloaded from the World Wide Web at http://web.archive.org/web/20100413065253/http://www.fluke199.com/ as archived on Apr. 12, 2010.
Fluke Corporation, ScopeMeter 120 and 190 Series incl. 225C and 215C, Technical Data, Jan. 2010.
Fluke Corporation, Fluke 19×C-2×5C Scopemeter, Software version 8.00 onwards, Users Manual, Jul. 2008.
Jones, Mike, Senior Fae, Micrel Inc., Ethernet Driving Down Automotive Cost of Ownership; Oct. 31, 2008.
Nucology Engineering, Inc., Nology, PDA-Dyno and OBD II Scan Tool Operating Manual, 2009.
obd-2.com, OBDII Automotive Scan Tool and Virtual Dashboard, downloaded from the World Wide Web at http://www.obd-2.com/ on Jul. 11, 2010.
U.S. Appl. No. 12/859,077, filed Aug. 18, 2010.
U.S. Appl. No. 12/858,699, filed Aug. 18, 2010.
U.S. Appl. No. 12/859,082, filed Aug. 18, 2010.
U.S. Appl. No. 13/189,940, filed Jul. 25, 2011.
U.S. Appl. No. 13/205,318, filed Aug. 8, 2011.
U.S. Appl. No. 13/198,530, filed Aug. 4, 2011.
U.S. Appl. No. 12/913,249, filed Oct. 27, 2010.
U.S. Appl. No. 12/913,184, filed Oct. 27, 2010.
U.S. Appl. No. 12/859,011, filed Aug. 18, 2010.
U.S. Appl. No. 12/859,040, filed Aug. 18, 2010.
U.S. Appl. No. 12/858,725, filed Aug. 18, 2010.
U.S. Appl. No. 13/198,426, filed Aug. 4, 2011.
U.S. Appl. No. 12/859,051, filed Aug. 18, 2010.

* cited by examiner

| Buffer Byte No. | Data Address | Ch. No. | Frame No. | Frame Byte No. |
|---|---|---|---|---|
| Byte 1 | 0000 | Ch. 1 | Frame 1 | Byte 1 |
| Byte 2 | 0001 | Ch. 2 | Frame 2 | Byte 1 |
| Byte 3 | 0002 | Ch. 1 | Frame 1 | Byte 2 |
| Byte 4 | 0003 | Ch. 2 | Frame 2 | Byte 2 |
| Byte 5 | 0004 | Ch. 1 | Frame 1 | Byte 3 |
| Byte 6 | 0005 | Ch. 2 | Frame 2 | Byte 3 |
| Byte 7 | 0006 | Ch. 1 | Frame 1 | Byte 4 |
| Byte 8 | 0007 | Ch. 2 | Frame 2 | Byte 4 |
| . | . | . | . | . |
| . | . | . | . | . |
| Byte 1159 | 0487 | Ch. 1 | Frame 1 | Byte 580 |
| Byte 1160 | 0488 | Ch. 2 | Frame 2 | Byte 580 |
| Byte 1161 | 0489 | Ch. 1 | Frame 3 | Byte 1 |
| Byte 1162 | 048A | Ch. 2 | Frame 4 | Byte 1 |
| . | . | . | . | . |
| . | . | . | . | . |
| Byte 2315 | 090B | Ch. 1 | Frame 3 | Byte 578 |
| Byte 2316 | 090C | Ch. 2 | Frame 4 | Byte 578 |
| Byte 2317 | 090D | Ch. 1 | Frame 3 | Byte 579 |
| Byte 2318 | 090E | Ch. 2 | Frame 4 | Byte 579 |
| Byte 2319 | 090F | Ch. 1 | Frame 3 | Byte 580 |
| Byte 2320 | 0910 | Ch. 2 | Frame 4 | Byte 580 |

FIG. 9

SYSTEM AND METHOD FOR DISPLAYING INPUT DATA ON A REMOTE DISPLAY DEVICE

RELATED APPLICATIONS

This application claims priority to U.S. provisional patent application No. 61/374,825 filed on Aug. 18, 2010. U.S. provisional patent application No. 61/374,825 is incorporated herein by reference.

BACKGROUND

Vehicles, such as automobiles, light-duty trucks, and heavy-duty trucks, play an important role in the lives of many people. To keep vehicles operational, some of those people rely on vehicle technicians to diagnose and repair their vehicle.

Vehicle technicians use a variety of tools in order to diagnose and/or repair vehicles. Those tools may include common hand tools, such as wrenches, hammers, pliers, screwdrivers and socket sets, or more vehicle-specific tools, such as cylinder hones, piston ring compressors, and vehicle brake tools. The tools used by vehicle technicians may also include electronic tools such as a digital voltage-ohm meter (DVOM) or a vehicle scan tool that communicates with an electronic control unit (ECU) within a vehicle.

Vehicle technicians may work at various locations of a vehicle in order to diagnose and/or repair the vehicle. For example, while working on an automobile having a passenger compartment and an under-hood area containing an internal combustion engine, a vehicle technician may desire to work at the under-hood area and at the passenger compartment. For example, the vehicle technician may desire to use a DVOM to make a voltage measurement at the under-hood area while the technician operates user controls within the passenger compartment so as to re-create a vehicle performance complaint (e.g., a cylinder misfire). However, the vehicle technician may be unable to view the DVOM at the under-hood area while operating the user controls within the passenger compartment. In such a situation, the vehicle technician may be unable to carry out the desired voltage measurement or the vehicle technician may need the assistance of another person to either operate the user controls or to read the DVOM.

OVERVIEW

Various example embodiments are described in the following detailed description. In one respect, an example embodiment may take the form of a method comprising: (i) generating first input data from a first input signal received at a data acquisition (DAQ) device, wherein generating the first input data comprises repeatedly generating input data from a respective most-recently received portion of the first input signal, wherein the DAQ device comprises a first buffer that is operable to store two frames of the first input data, wherein the DAQ device comprises a first display for displaying at least a half-frame of the first input data, and wherein the DAQ device is operable in a first display mode and in a second display mode, (ii) wherein, while the DAQ device is operating in the first display mode or the second display mode, repeatedly updating the first buffer to store two frames of first input data, generated from the most-recently received portion of the first input signal, instead of any other generated first input data, (iii) wherein, while the DAQ device is operating in the first display mode, the DAQ device repeatedly providing the first display with at least a half-frame portion of the two frames of first input data stored in the first buffer, and (iv) wherein, while the DAQ device is operating in the second display mode, the DAQ device repeatedly receiving, via a wireless network, a respective request to transmit live data to a remote display device and the DAQ device responsively transmitting, via the wireless network, a respective one frame portion of the two frames of first input data stored in the first buffer.

In another respect, an example embodiment may take the form of a DAQ device comprising: (i) one or more input channels operable to receive input signals from a device-under-service, (ii) a first buffer operable to store more than two frames of historical input data generated from the input signals received at the one or more input channels, (iii) a second buffer operable to store, for each input channel of the one or more input channels, two frames of live input data generated at the DAQ device or two frames of historical input data stored in the first buffer, (iv) a first display operable to visually present input data generated at the DAQ device, wherein, when the first display visually presents the input data, the first display visually presents, for one or more input channels of the DAQ device, at least a half-frame portion of the input data stored in the second buffer, and (v) a wireless transceiver operable to receive a request for input data, wherein the request for input data is transmitted to the wireless transceiver from a display device comprising a second display operable to visually present input data generated at the DAQ device, and wherein the wireless transceiver is operable to transmit, to the display device, a respective one-frame portion of input data for one or more of the input channels of the DAQ device.

In yet another respect, an example embodiment may take the form of a display system comprising: (i) a display device operable to visually present input data, (ii) a wireless transceiver operable to transmit from the display device a request for the input data to a DAQ device via a wireless network, wherein the wireless transceiver is operable to receive the input data from the DAQ device via the wireless network, and (iii) a user interface operable to receive a selection of whether the requested input data is live input data or historical input data. When the display device operates to visually present the input data, the display device visually presents one frame of input data for one or more input channels at the DAQ device. When the DAQ device operates to visually present input data, a display at the DAQ device visually presents at least a half frame of input data for one or more of the input channels at the DAQ device.

These as well as other aspects and advantages will become apparent to those of ordinary skill in the art by reading the following detailed description, with reference where appropriate to the accompanying drawings. Further, it should be understood that the embodiments described in this overview and elsewhere are intended to be examples only and do not necessarily limit the scope of the claims.

BRIEF DESCRIPTION OF THE DRAWINGS

Example embodiments are described herein with reference to the drawings, in which:

FIG. 8 to FIG. 10 illustrate details of the DAQ device of FIG. 5;

DETAILED DESCRIPTION

I. Introduction

This description describes a system including multiple devices for use in servicing (e.g., diagnosing and/or repairing) a device-under-service. The multiple devices may include a display device, a data acquisition (DAQ) device, and a vehicle scanner. The multiple devices may operate independently (e.g., as a stand-alone device) as well as in combination with each other. Each of the multiple devices may alternatively be referred to as an apparatus.

Each of the multiple devices is operable to carry out functions for servicing a device-under-service. The device-under-service may comprise a vehicle, a refrigeration unit, a personal computer, or some other serviceable device. Additionally or alternatively, the device-under-service may comprise a system such as a heating, ventilation, and air conditioning (HVAC) system, a security system, a computer system (e.g., a network), or some other serviceable system. The functions for servicing the device-under-service may include but are not limited to diagnostic functions, measurement functions, analysis functions, and scanning functions.

To work in combination with each other, the multiple devices are operable to communicate with each other via a communications network. The communications network may comprise a wireless network, a wired network, or both a wireless network and a wired network. Data obtained by a device from a device-under-service or data otherwise contained in that device may be transmitted to another device via the communications network.

The DAQ device may generate input data from input signals acquired at the DAQ device. The input data may be stored in various data buffers within the DAQ device. The input data may be displayed on a display at the DAQ device as live input data or as historical input data. The live input data comprises the most-recently generated input data, whereas the historical input data comprises input data generated prior to the most-recently generated input data.

The display device may request input data from the DAQ device. The DAQ device may comprise a buffer dedicated for input data to be transmitted to the display device. The input data contained within that dedicated buffer may be received directly from an analog-to-digital converter block that generates the input data or indirectly from a buffer that contains input data suitable for visually presenting on a display of the display device.

The use of a system with multiple devices communicating via a communications network provides a technician with the flexibility to operate the devices at distinct locations relative to a device-under-service. For example, when the device-under-service is an automobile, the DAQ device may be located and connected to components within the engine compartment, whereas the display device may be located in the passenger compartment.

II. Example Architecture

Figure 1:
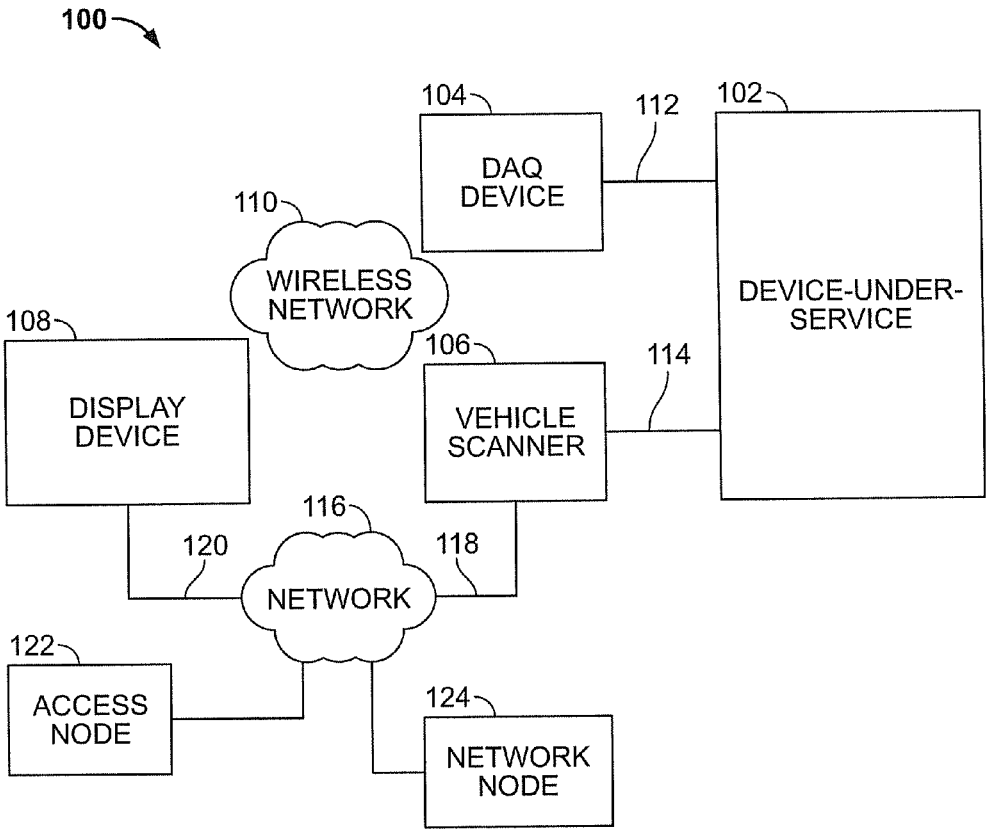
FIG. 1 is a block diagram of a system in accordance with an example embodiment.

FIG. 1 is a block diagram of a system 100 in accordance with an example embodiment. System 100 comprises a device-under-service 102, a data acquisition device (DAQ) device 104, a vehicle scanner 106, and a display device 108. Display device 108 may be referred to as a controller device since display device 108 may operate as a master of DAQ device 104 and/or vehicle scanner 106 when those devices are operating as a slave device or slave scanner, respectively.

The block diagram of FIG. 1 and other block diagrams and flow charts accompanying this description are provided merely as examples and are not intended to be limiting. Many of the elements illustrated in the figures and/or described herein are functional elements that may be implemented as discrete or distributed components or in conjunction with other components, and in any suitable combination and location. Those skilled in the art will appreciate that other arrangements and elements (for example, machines, interfaces, functions, orders, and groupings of functions, etc.) can be used instead. Furthermore, various functions described as being performed by one or more elements can be carried out by a processor executing computer-readable program instructions and/or by any combination of hardware, firmware, and software.

A wireless network 110 may be established between any two or more of DAQ device 104, vehicle scanner 106, and display device 108. DAQ device 104, vehicle scanner 106, and display device 108 are operable to carry out communications with each other via wireless network 110. Other devices, such as a personal digital assistant (PDA), may be operable to join wireless network 110 so as to communicate with devices communicating via wireless network 110.

Wireless network 110 may comprise one or more wireless networks. Each of the one or more wireless networks may be arranged to carry out communications according to a respective air interface protocol. Each air interface protocol may be arranged according to an industry standard, such as an Institute of Electrical and Electronics Engineers (IEEE) 802 standard. The IEEE 802 standard may comprise an IEEE 802.11 standard for Wireless Local Area Networks (e.g., IEEE 802.11 a, b, g, or n), an IEEE 802.15 standard for Wireless Personal Area Networks, an IEEE 802.15.1 standard for Wireless Personal Area Networks—Task Group 1, an IEEE 802.16 standard for Broadband Wireless Metropolitan Area Networks, or some other IEEE 802 standard. For purposes of this description, a wireless network arranged to carry out communications according to the IEEE 802.11 standard is referred to as a Wi-Fi network, and a wireless network arranged to carry out communications according to the IEEE 802.15.1 is referred to as a Bluetooth network.

Figure 5:
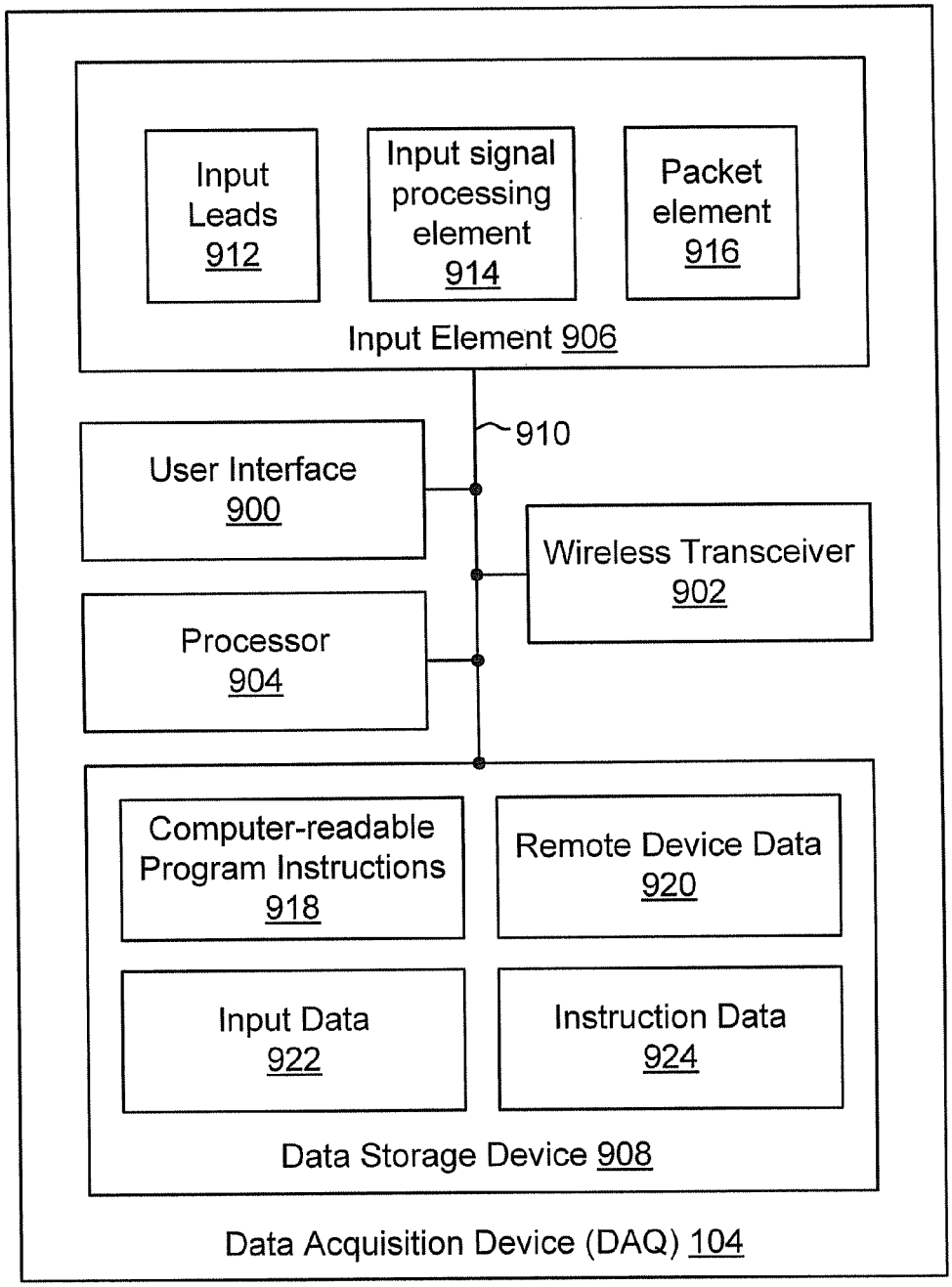
FIG. 5 is a block diagram of an example data acquisition (DAQ) device.

DAQ device 104 may connect to device-under-service 102 via wired link 112. Wired link 112 may comprise input leads 912, as shown in FIG. 5. DAQ device 104 may comprise a digital volt meter (DVM), a digital volt ohm meter (DVOM), an oscilloscope, or some other type of measurement device operational to acquire data from device-under-service 102. An oscilloscope within DAQ device 104 may comprise, 1, 2, 3, or more distinct input channels.

Vehicle scanner 106 may connect to device-under-service 102 via wired link 114. Wired link 114 may be arranged as a cable assembly described in U.S. Patent Application No. 61/374,805, which is incorporated herein by reference, and which was filed on Aug. 18, 2010 and is entitled "Cable assembly for protection against undesired signals," or wired link 114 may be arranged as some other wired link. Vehicle scanner 106 may comprise a device that is operable to request and/or monitor data from one or more electronic control units (ECU) located on and/or within device-under-service 102. The data from the ECU(s) may comprise serial data arranged according to serial data available at an On Board Diagnostic (OBD) II connector within an automobile, such as a Society of Automotive Engineers (SAE) J1850 standard or an International Organization for Standardization (ISO) 9141-2 standard.

Vehicle scanner 106 may be operable as a stand-alone-device when vehicle scanner 106 operates as a data recorder to collect data from device-under-service 102 and other devices of system 100 are not connected to device-under-service 102 or communicating with vehicle scanner 106. Such data obtained when vehicle scanner operates as a data recorder can subsequently be displayed via another device of system 100, such as display device 108. Additional details regarding vehicle scanner are recited in U.S. Patent Application No. 61/374,707, which is incorporated herein by reference, and which was filed on Aug. 18, 2010 and is entitled "System and Method for Integrating devices for servicing a device-under-service," and in U.S. Patent Application No. 61/374,845, which is incorporated herein by reference, and which was filed on Aug. 18, 2010 and is entitled "System and method for simultaneous display of waveforms generated from input signals received at a data acquisition device."

Device-under-service 102 may comprise a vehicle, such as an automobile, a motorcycle, a semi-tractor, a light-duty truck, a medium-duty truck, a heavy-duty truck, farm machinery, or some other vehicle. System 100 is operable to carry out a variety of functions, including functions for servicing device-under-service 102. The example embodiments may include or be utilized with any appropriate voltage or current source, such as a battery, an alternator, a fuel cell, and the like, providing any appropriate current and/or voltage, such as about 12 volts, about 42 volts, and the like. The example embodiments may be used with any desired system or engine. Those systems or engines may comprise items utilizing fossil fuels, such as gasoline, natural gas, propane, and the like, electricity, such as that generated by battery, magneto, fuel cell, solar cell and the like, wind and hybrids or combinations thereof. Those systems or engines may be incorporated into other systems, such as an automobile, a truck, a boat or ship, a motorcycle, a generator, an airplane and the like.

Vehicle scanner 106 and display device 108 may connect to a network 116 via wired links 118 and 120, respectively. Network 116 may include and/or connect to the Internet, and network 116 may include and/or connect to one or more network nodes, such as an access node 122 and a network node 124. Access node 122 may provide any of DAQ device 104, vehicle scanner 106, and display device 108 with wireless connectivity to network 116. Network node 124 may comprise a desktop personal computer (PC), a workstation that executes a Unix-based or Linux-based operating system, or some other node that interfaces and/or connects to network 116. In accordance with an example in which device-under-service 102 comprises an automobile, network node 124 may comprise a desktop PC or workstation operating at an automobile repair facility. In that regard, network node 124 may operate as a server that provides data (e.g., automobile repair data and/or instruction data) to display device 108.

Figure 2:
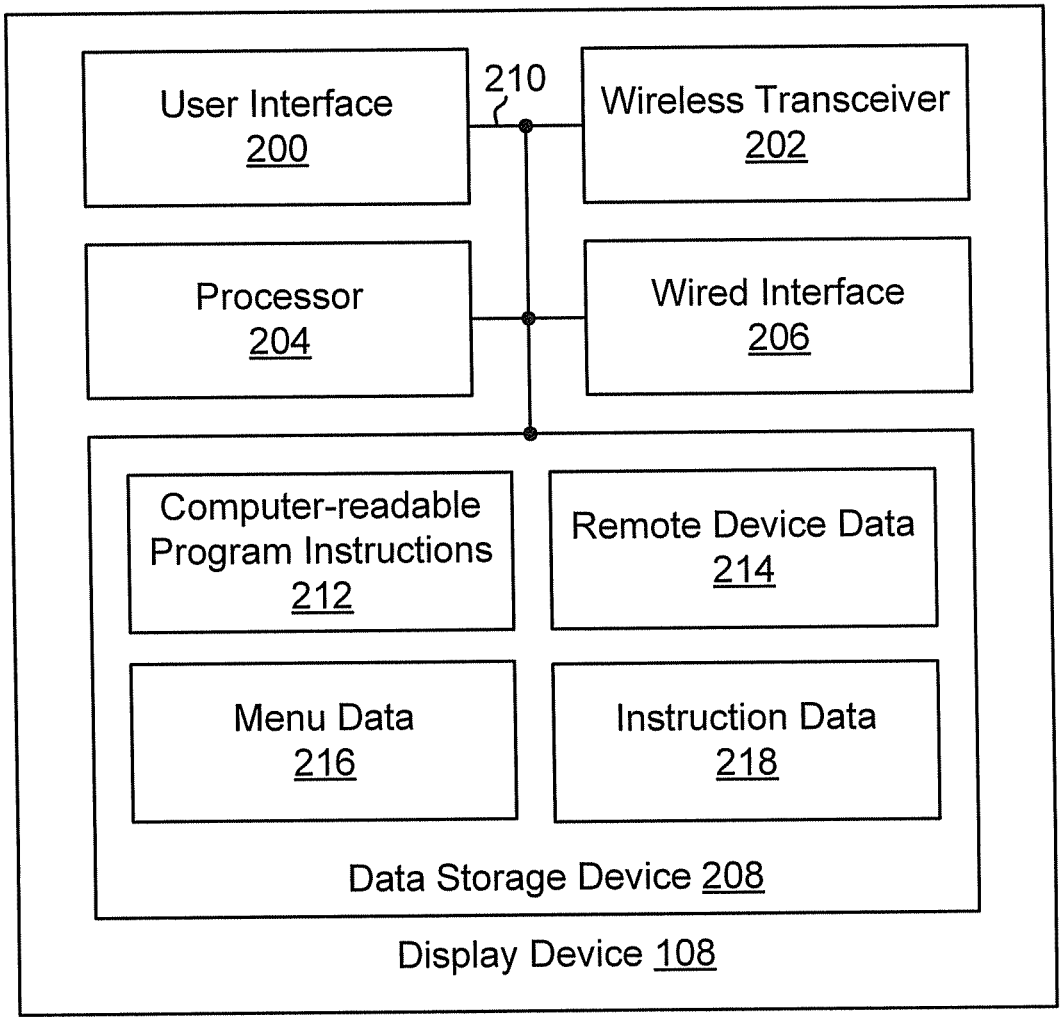
FIG. 2 is a block diagram of an example display device.
Figure 3:
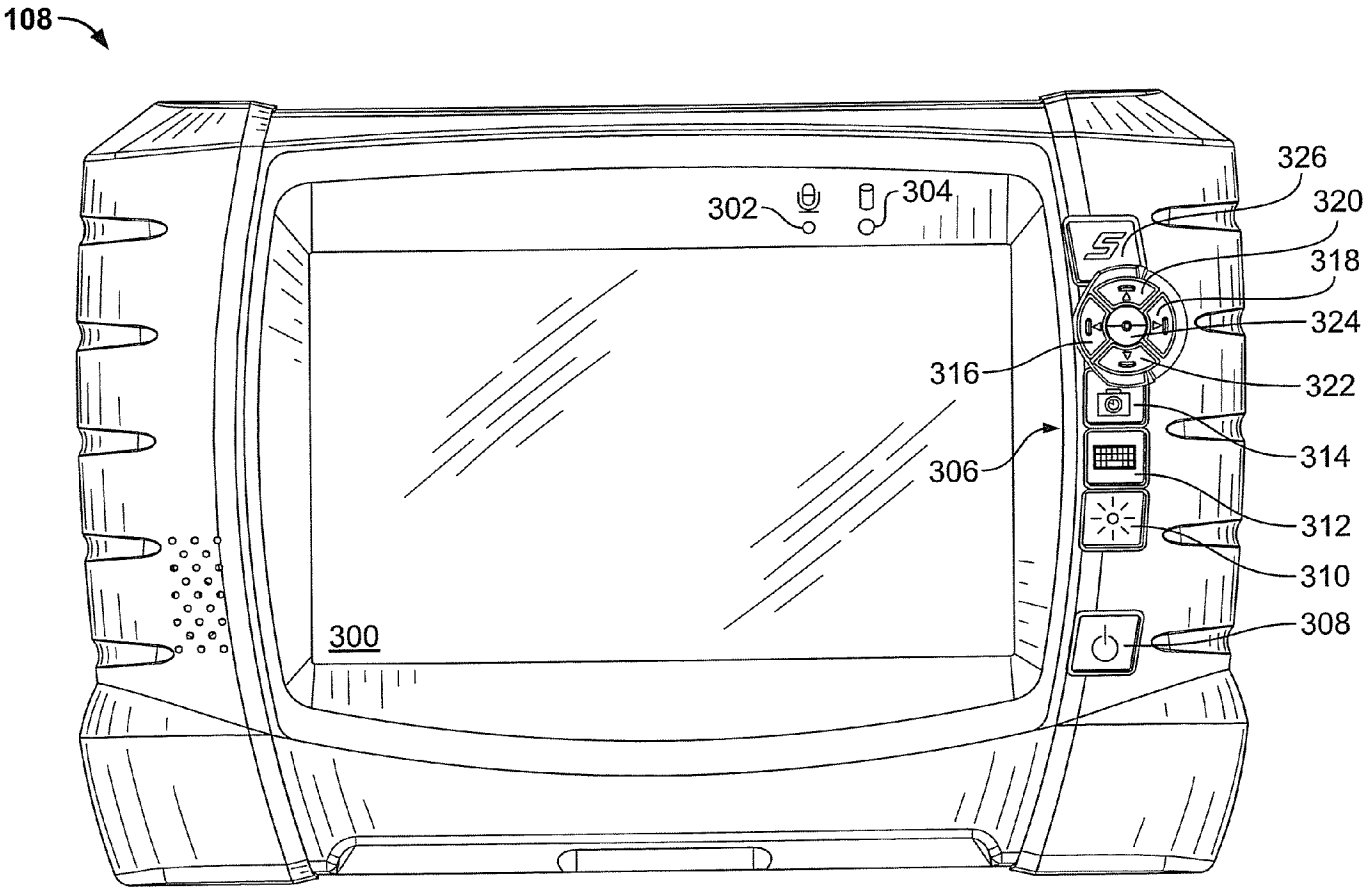
FIG. 3 and FIG. 4 illustrate various views of an example embodiment of the display device of FIG. 2.
Figure 4:
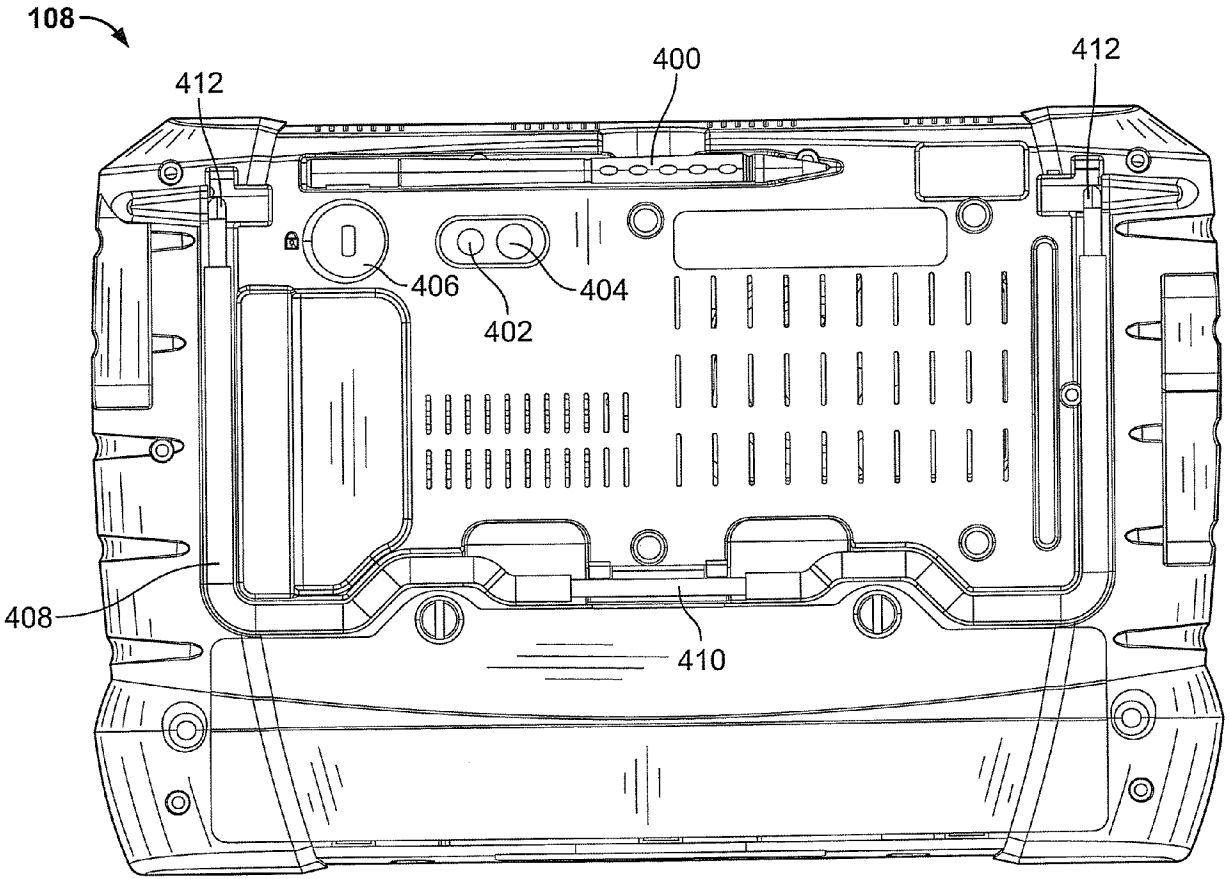

Next, FIG. 2 is a block diagram of display device 108, and FIG. 3 and FIG. 4 illustrate details of an example embodiment of display device 108. As illustrated in FIG. 2, display device 108 includes a user interface 200, a wireless transceiver 202, a processor 204, a wired interface 206, and a data storage device 208, all of which may be linked together via a system bus, network, or other connection mechanism 210.

User interface 200 is operable to present data to a user and to enter user inputs (e.g., user selections). User interface 200 may include a display, such as display 300 illustrated in FIG. 3. Display 300 is operable to visually present data, such as data transmitted to wireless transceiver 202 from a remote device (e.g., DAQ device 104 or vehicle scanner 106), data that is transmitted to wired interface 206, data stored at data storage device 208 (e.g., menu data 216), or some other type of data. Display 300 may simultaneously display data that is transmitted to display device 108 from DAQ device 104 and data that is transmitted to display device 108 from vehicle scanner 106. User interface 200 may include a selection element that is operable to enter a user selection. Examples of the selection element are illustrated in FIG. 3 and FIG. 4.

Wireless transceiver 202 comprises a wireless transceiver that is operable to carry out communications via wireless network 110. Wireless transceiver 202 may carry out communications with one or more remote devices, such as one or more of DAQ device 104, vehicle scanner 106, and some other device (other than display device 108) that is operating to communicate via wireless network 110. As an example, wireless transceiver 202 may comprise a transceiver that is operable to carry out communications via a Bluetooth network. For purposes of this description, a transceiver that is operable to carry out communications via a Bluetooth network is referred to as a Bluetooth transceiver. As another example, wireless transceiver 202 may comprise a transceiver that is operable to carry out communications via a Wi-Fi network. For purposes of this description, a transceiver that is operable to carry out communications via a Wi-Fi network is referred to as a Wi-Fi transceiver.

In accordance with an embodiment in which DAQ device 104, vehicle scanner 106, and display device 108 each include a single wireless transceiver (e.g., a Bluetooth transceiver), one of the devices, such as display device 108, can operate as a master (e.g., a controller), and the other devices, such as DAQ device 104 and vehicle scanner 106, can operate as slaves to the master. DAQ device 104, vehicle scanner 106, and display device 108 may transmit communications via wireless network 110 using a time-division duplex arrangement and synchronized to a clock signal of the master.

Under a given implementation of a Bluetooth network, up to seven devices may actively exchange data with a master of the Bluetooth network. When one of the seven devices transitions from being an active device to a parked device, another parked device can transition from being a parked device to an active device that can exchange data with the master. If display device 108 is operating as the master of the Bluetooth network, then up to seven remote devices may actively exchange data with display device 108. As an example, the remote devices exchanging data with display device 108 may include DAQ device 104 and vehicle scanner 106. As another example, the remote devices exchanging data with display device 108 may include DAQ device 104, vehicle scanner 106, and another data acquisition device (arranged similar to DAQ device 104). Other examples of remote devices that can operate as one of seven devices actively exchanging data with display device 108 when display device 108 is operating as the master are also possible.

Wireless transceiver 202 is not limited to a single wireless transceiver. For example, wireless transceiver 202 may comprise a Bluetooth transceiver and a Wi-Fi transceiver. In accordance with such an example, the Bluetooth transceiver may communicate with DAQ device 104 and/or vehicle scanner 106 via a Bluetooth network of wireless network 110, and the Wi-Fi transceiver may communicate with DAQ device 104 and/or vehicle scanner 106 via a Wi-Fi network of wireless network 110.

In accordance with an embodiment in which display device 108 includes two wireless transceivers (e.g., a Bluetooth transceiver and a Wi-Fi transceiver) and DAQ device 104 and vehicle scanner 106 each include two wireless transceivers (e.g., a Bluetooth transceiver and a Wi-Fi transceiver), DAQ device 104 and vehicle scanner 106 may simultaneously transmit data to display device 108 for display via display 300. In that regard, DAQ device 104 may transmit data to display device 108 via the Bluetooth network of wireless network 110 and vehicle scanner 106 may transmit data to display device 108 via the Wi-Fi network of wireless network 110. Alternatively, DAQ device 104 and vehicle scanner 106 may take turns transmitting data to display device 108 via the Bluetooth network, the Wi-Fi network, or both the Bluetooth network and the Wi-Fi network.

In accordance with an embodiment in which wireless transceiver 202 includes three or more wireless transceivers, two or more of the wireless transceivers may communicate according to a common air interface protocol or different air interface protocols.

Each wireless transceiver of the example embodiments may operate in a transceiver-on state. In the transceiver-on state, the transceiver is powered on. While operating in the transceiver-on state, the transceiver can transmit and receive data via an air interface. For some transceivers, while operating in the transceiver-on state, the transceiver can transmit and receive data via the air interface simultaneously. For other transceivers, at any given time while operating in the transceiver-on state, the transceiver can either transmit data or receive data via the air interface. Each wireless transceiver of the example embodiments may operate in a transceiver-off state. While operating in the transceiver-off state, the transceiver does not transmit or receive data via an air interface. While operating in the transceiver-off state, the transceiver can be powered off.

Wired interface 206 may include one or more ports. Each port of wired interface 206 provides an interface to display device 108 and to one or more circuits. In one respect, the one or more circuits may comprise electrical circuits, such as the electrical circuits of a Universal Serial Bus (USB) cable or the electrical circuits of an Ethernet cable (e.g., a CAT 5 cable). In another respect, the one or more circuits may comprise optical fibers that are operable to carry optical signals. Other examples of the one or more circuits are also possible.

Processor 204 may comprise one or more general purpose processors (e.g., INTEL microprocessors) and/or one or more special purpose processors (e.g., digital signal processors). Processor 204 may execute computer-readable program instructions (CRPI) 212 that are contained in computer-readable data storage device 208.

Data storage device 208 may comprise a non-transitory computer-readable storage medium readable by processor 204. The computer-readable storage medium may comprise volatile and/or non-volatile storage components, such as optical, magnetic, organic or other memory or disc storage, which can be integrated in whole or in part with processor 204. Data storage device 208 may contain various data including, but not limited to, CRPI 212, remote device data 214, menu data 216, and instruction data 218.

Remote device data 214 may include data associated with a device that is arranged to communicate with display device 108 via wireless network 110. For example, remote device data 214 may include data associated with DAQ device 104, such as a radio identifier and password associated with DAQ device 104. The data associated with DAQ device 104 may be received at display device 108, for storing as remote device data 214, during a pairing process carried out between display device 108 and DAQ device 104. The pairing process between DAQ device 104 and display device 108 may include DAQ device 104 providing display device 108 with the data (e.g., a passkey) associated with DAQ device 104 and display device 108 providing DAQ device 104 with data (e.g., a passkey) associated with display device 108. After carrying out the paring process with DAQ device 104, display device 108 may use the remote device data 214 when establishing communication network 110 with DAQ device 104.

Instruction data 218 may comprise various data. As an example, instruction data 218 may comprise data that illustrates how to connect DAQ device 104 and/or vehicle scanner 106 to device-under-service 102. As another example, instruction data 218 may comprise diagnostic information for diagnosing device-under-service 102. For instance, in accordance with an example embodiment in which device-under-service 102 comprises an automobile, the diagnostic information may comprise diagnostic flow charts for diagnosing an electrical system on the automobile. The diagnostic flow charts can provide different paths to follow based on measurement data display device 108 obtains from DAQ device 104 and/or vehicle scanner 106. The diagnostic flow charts can guide a technician in diagnosing device-under-service 102 so as to determine the cause of a component or system failure within device-under-service 102. Such flow charts may be presented to the technician in response to display device comparing waveform data received from DAQ device 104 with known-good or known-bad waveform data stored at data storage device 208.

Figure 15:
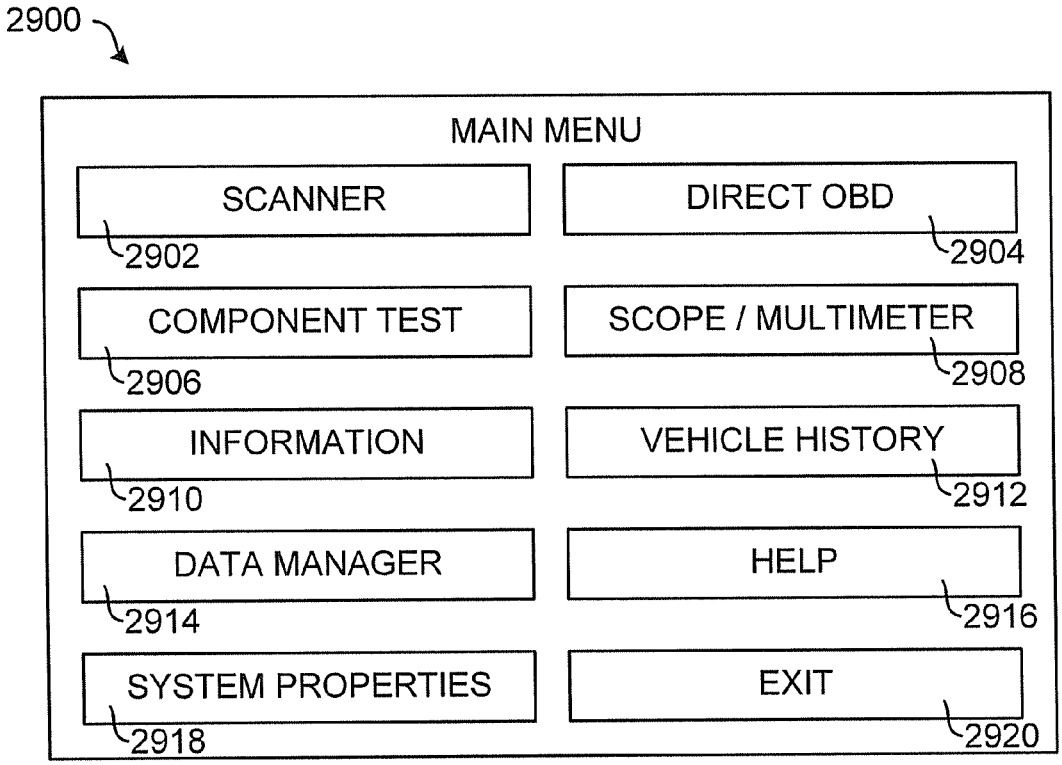
FIG. 15 and FIG. 16 illustrate example menu data displayable on the display device of FIG. 2.
Figure 16:
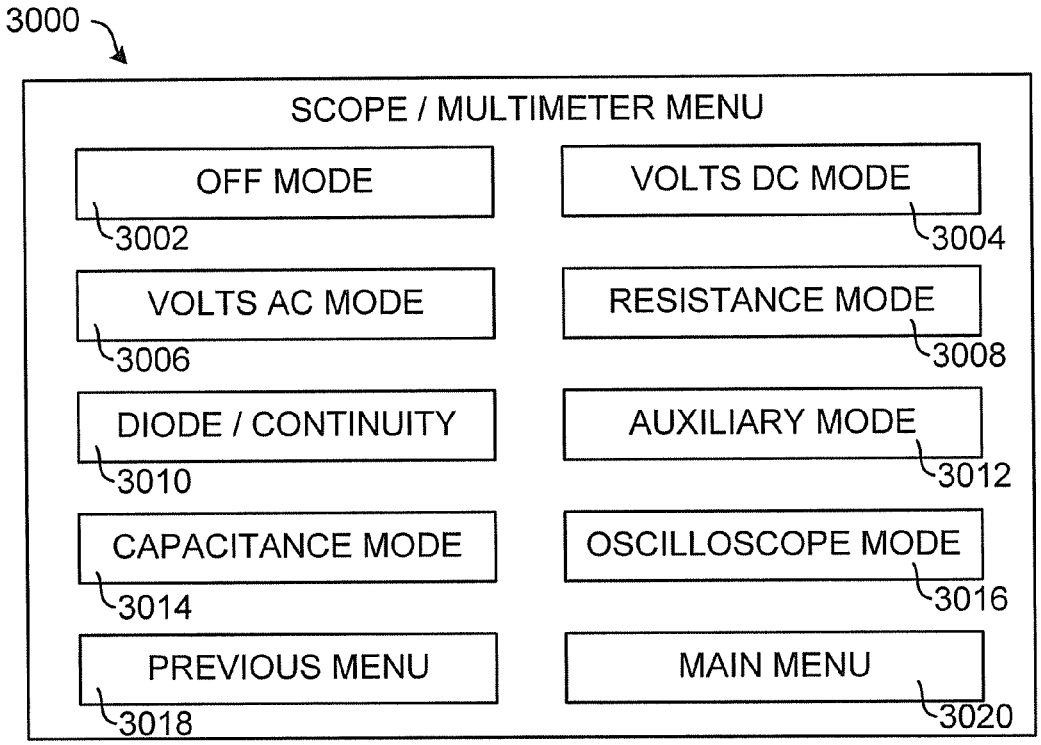

Menu data 216 comprises data that can be visually presented via display 300. FIG. 15 and FIG. 16 illustrate examples of menu data 216 displayable on display 300. Each of those figures illustrates a respective menu (i.e., main menu 2900 and scope/multimeter menu 3000). Each respective menu may comprise one or more menu items that is/are selectable by a user. Selection of a menu item can cause display 300 to display instruction data 218. Additionally or alternatively, selection of a menu item can cause wireless transceiver 202 to transmit instruction data 218 to a remote device (e.g., DAQ device 104 or vehicle scanner 106) as payload of a message, such as data-share message 3500 illustrated in FIG. 13 or to transmit a mode-selection command to the remote device, such as mode-selection command 3400 illustrated in FIG. 11.

As an example, starting at FIG. 15, a user may select menu item 2908 by touching display 300 where menu item 2908 is being displayed. In response to selecting menu item 2908, scope/multimeter menu 3000 (shown in FIG. 16) may be visually presented on display 300. A user may select menu item 3016 where menu item 3016 is being displayed. In response to selecting menu item 3016, an oscilloscope display 1700 (shown in FIG. 17) may be visually presented on display 300.

Figure 17:
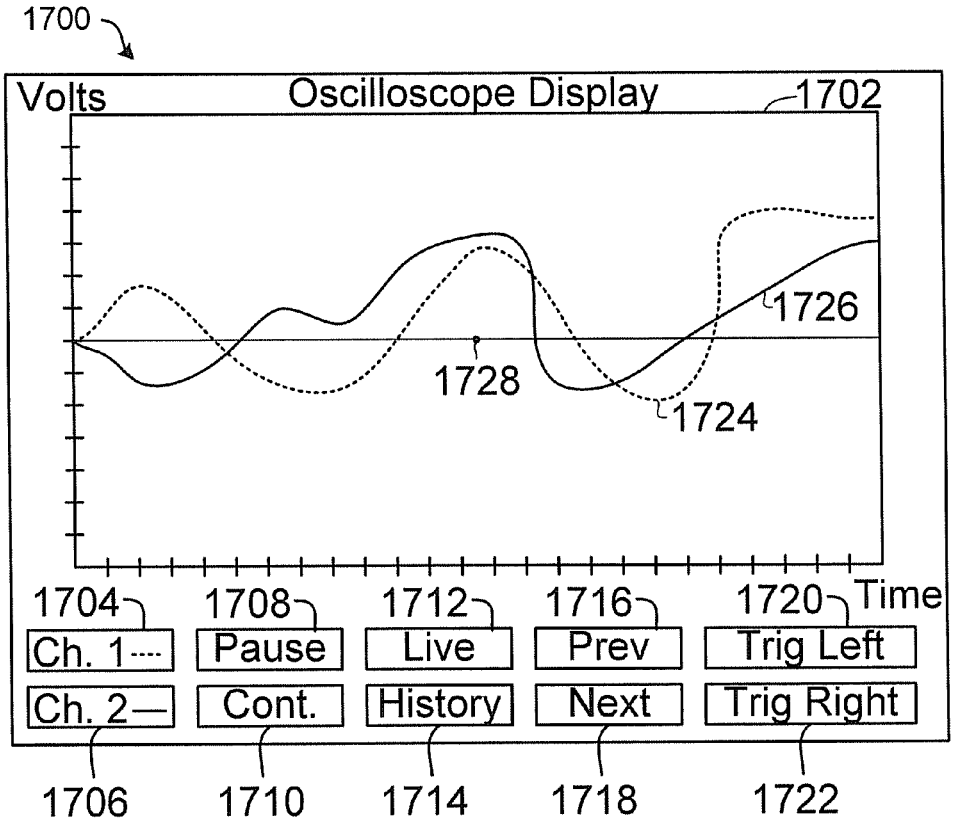
FIG. 17 illustrates an example oscilloscope display visually presentable via the display device of FIG. 2.

Turning to FIG. 17, oscilloscope display 1700 includes a waveform display portion 1702 and one or more oscilloscope function selectors. The oscilloscope function selectors include a channel 1 selector 1704, a channel 2 selector 1706, a pause selector 1708, a continue (e.g., un-pause) selector 1710, a live input data selector 1712, a historical input data selector 1714, a previous input data selector 1716, a next input data selector 1718, a trigger left selector 1720, and a trigger right selector 1722. In accordance with an alternative arrangement, the oscilloscope function selectors may include additional oscilloscope channel selectors corresponding to oscilloscope channels at DAQ device 104. For instance, the additional oscilloscope channel selectors may include a channel 3 selector (not shown) and a channel 4 selector (not shown) in an embodiment in which DAQ device 104 includes four oscilloscope channels. Other examples of the number of oscilloscope channels at DAQ device 104 are also possible.

As shown in FIG. 17, waveform display portion 1702 includes horizontal divisions at the bottom of waveform display portion 1702 and vertical divisions at the left side of waveform display portion 1702. As an example, and as shown in FIG. 17, the horizontal divisions can represent time divisions and the vertical divisions can represent voltage (i.e., volts). Other examples, of what the horizontal and vertical divisions represent and other examples of divisions within and/or adjacent to waveform display portion 1702 are also possible.

Waveform display portion 1702 can display waveforms, such as a channel 1 waveform 1724 and a channel 2 waveform 1726. Channel 1 waveform 1724 can be generated from input data generated from input signals acquired by an input channel of DAQ device 104 (e.g., input channel 3600 shown in FIG. 6). Similarly, channel 2 waveform 1726 can be generated from input data generated from input signals acquired by another input channel of DAQ device 104 (e.g., input channel 3602 shown in FIG. 6).

Channel 1 selector 1704 can be selected to trigger whether channel 1 waveform 1724 is displayed on waveform display portion 1702. Channel 1 selector 1704 can include a legend (i.e., the dashed line) to identify channel 1 waveform 1724 as the waveform associated with channel 1. Similarly, channel 2 selector 1706 can be selected to trigger whether channel 2 waveform 1726 is displayed on waveform display portion 1702. Channel 2 selector 1706 can include a legend (i.e., the solid line) to identify channel 2 waveform 1721 as the waveform associated with channel 2.

Pause selector 1708 can be selected to cause waveform display portion 1702 to pause. Pausing waveform display portion 1702 may include repeatedly displaying a single frame of input data for each input channel currently displayed on waveform display portion 1702.

Continue selector 1710 can be selected to cause waveform display portion 1702 to continuously refresh itself, for each input channel, with a frame of input data that was not the previously-displayed frame of input data.

Live input data selector 1712 can be selected to trigger display device 108 to request live input data from DAQ device 104. In one respect, if live input data selector 1712 is selected while waveform display portion 1702 is displaying historical input data, waveform display portion 1702 can transition to display live input data for all input channels being displayed. In another respect, if live input data selector 1712 is selected while waveform display portion 1702 is displaying historical input data for both channel 1 and channel 2, the live input data selector 1712 can be selected for a given input channel (e.g., channel 1) such that waveform display portion 1702 subsequently displays live input data for channel 1 and continues to display historical input data for channel 2.

Historical input data selector 1714 can be selected to trigger display device 108 to request historical input data from DAQ device 104. In one respect, if historical input data selector 1704 is selected while waveform display portion 1702 is displaying live input data, waveform display portion 1702 can transition to display historical input data for all input channels being displayed. In another respect, if historical input data selector 1704 is selected while waveform display portion 1702 is displaying live input data for both channel 1 and channel 2, the historical input data selector 1714 can be selected for a given input channel (e.g., channel 1) such that waveform display portion 1702 subsequently displays historical input data for channel 1 and continues to display live input data for channel 2.

Previous input data selector 1716 can be selected to trigger waveform display portion 1702 to display a previous frame (i.e., a frame captured earlier in time) of historical input data for each channel that is currently displaying a frame of historical input data on waveform display portion 1702.

Next input data selector 1718 can be selected to trigger waveform display portion 1702 to display a next frame (i.e., a frame captured later in time) of historical input data for each channel that is currently displaying a frame of historical input data on waveform display portion 1702.

Trigger left selector 1720 can be selected to move a trigger point 1728 towards the left side of waveform display portion 1702. Trigger right selector 1722 can be selected to move trigger point 1728 towards the right side of waveform display portion 1702.

In addition to displaying waveforms, display device 108 may be operable to analyze waveforms and to display results of analyzing waveforms. In one respect, analyzing the waveform may include processor 204 executing CRPI 212 to compare a waveform and/or the data received from DAQ device 104 to generate the waveform with waveform analysis data, which may comprise waveform-comparison data for generating other waveforms referred to as known-good waveforms or known-bad waveforms. Additionally or alternatively, the waveform analysis data may include data identifying characteristics (e.g., amplitude, frequency, or duty cycle) of the known-good or known-bad waveforms.

The waveform-comparison data to generate each known-good and known bad waveform may be stored in data storage device 208, and that data may be associated with vehicle-identifier data, stored in data storage device 208, that identifies a type of vehicle from which the data to generate the known-good or known-bad waveform was determined. The vehicle-identifier data may indicate vehicle characteristics such as a vehicle make, model, and model year, a vehicle system, a vehicle component, a vehicle circuit identifier, and vehicle operating parameters such as engine RPM, coolant temperature, or some other operating parameter.

In order to compare a waveform received from DAQ device 104 with a known-good or known bad waveform, display device 108 may receive data that identifies one or more vehicle characteristics associated with a waveform received or to be received at display device 108 from DAQ device 104 and then locate, within data storage device 208, known-good and/or known bad waveforms associated with those same vehicle characteristics. Display device 108 may receive that data from user interface 200, wireless transceiver 202 and/or wired interface 206. After locating a known-good or known bad waveform and after receiving a waveform from DAQ device 104, processor 204 can execute CRPI 212 to compare characteristics of the located and received waveforms and make a determination as to whether or not the located and received waveforms match one another.

After comparing waveforms, processor 204 may execute CRPI 212 to cause display 300 to visually present data regarding the waveform matching determination (e.g., waveforms match or do not match). Display 300 may display both the located and retrieved waveforms simultaneously to allow a user to visually compare the waveforms. Additionally, processor 204 may execute CRPI 212 to cause display 300 to visually present information regarding diagnostic and/or repair procedures that are recommended to be carried out based on whether the compared waveforms match or do not match.

Returning to FIG. 2, CRPI 212 may comprise program instructions that are executable as an operating system that provides for direct control and management of hardware components (e.g., processor 204 and data storage device 208) of display device 108. The operating system can manage execution of other program instructions within CRPI 212. As an example, the operating system may comprise the Windows XP Embedded (XPe) operating system available from Microsoft Corporation, Redmond, Wash., United States, or some other operating system.

CRPI 212 may comprise program instructions that are executable by processor 204 to cause display 300 to detect selection of a function selector visible when oscilloscope display 1700 is visually presented and to generate messages to request data for displaying on oscilloscope display 1700 (e.g., input data request message 1200 (shown in FIG. 12)).

CRPI 212 may comprise program instructions that are executable by processor 204 to cause display 300 to display live and/or historical input data received at wireless transceiver 202 from DAQ device 104.

CRPI 212 may comprise program instructions that are executable by processor 204 to cause display 300 to display menu data 216 or instruction data 218. Displaying menu data 216 may include displaying a list of data-acquisition modes of DAQ device 104 or a list of data-acquisition modes of vehicle scanner 106.

CRPI 212 may comprise program instructions that are executable by processor 204 to identify a desired mode of a remote device (e.g., DAQ device 104 or vehicle scanner 106) selected from a list of data-acquisition modes displayed on display 300. The list of data-acquisition modes may be stored within menu data 216. User interface 200 may be used to select the desired mode from the displayed list of data-acquisition modes while the remote device is operating in a mode different than the desired mode.

CRPI 212 may comprise program instructions that are executable by processor 204 to generate a mode-selection command (e.g., mode selection command 3400) and to cause wireless transceiver 202 to transmit the mode-selection command via wireless network 110. Those program instructions may be executed in response to processor 204 identifying a desired mode selected from the displayed list of data-acquisition modes.

Next, FIG. 3 illustrates a front view of an example embodiment of display device 108. FIG. 3 further illustrates that display device 108 includes display 300, a microphone 302 for receiving audible data (e.g., voice data generated by a user of display device 108 or sounds generated by a motor vehicle), a status indicator 304 (e.g., a light emitting diode (LED)), and user controls 306. The voice data may include voice commands for making a mode-selection from a menu displayed on display 300. A microphone symbol is located above microphone 302 and a data storage device symbol is located above status indicator 304.

Display 300 may comprise a liquid crystal display (LCD), a plasma display, or some other type of display. Display 300 is operable to visually present (e.g., display) data to a user. Display 300 may visually present data using numbers, letters, punctuation marks, pictures, graphs, waveforms, or some other visually presentable form of data. The data visually presentable and/or presented at display 300 may include locally-acquired data (LAD), such as menu data 216 and a cursor that can be moved between menu items of menu data 216. The data visually presentable and/or presented at display 300 may include remotely-acquired data (RAD), such as data acquired via wireless transceiver 202 or wired interface 206.

Figure 7:
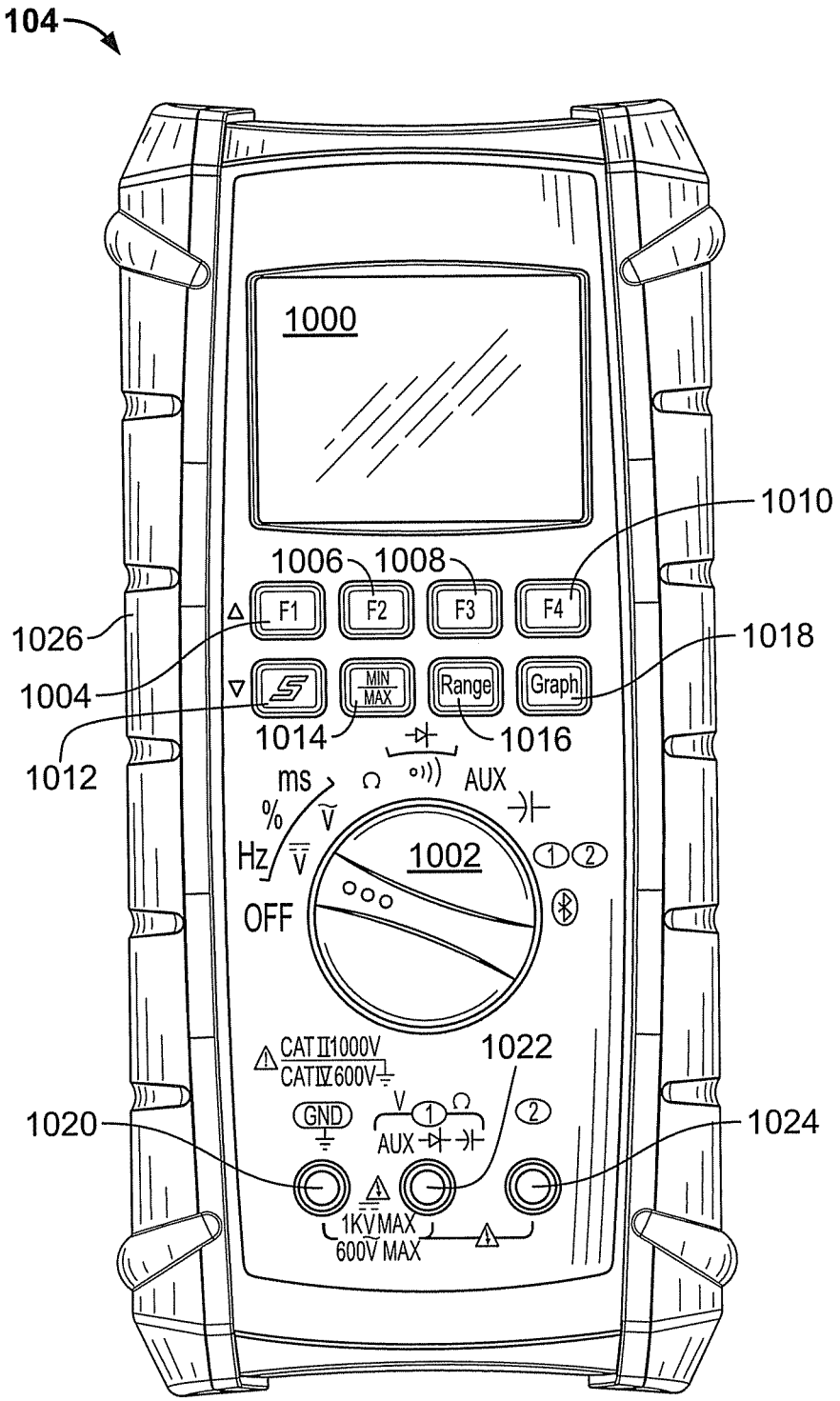
FIG. 7 illustrates a view of an example embodiment of the DAQ device of FIG. 5.

In accordance with an example embodiment, display 300 has a larger area to visually present data relative to the area for displaying data on a display of DAQ device 104 (e.g., display 1000 shown in FIG. 7). In accordance with the embodiment in which display 300 is operable to display data from DAQ device 104 while operating in an oscilloscope mode, for each input channel to be displayed, display 300 may visually present an amount of data referred to herein as a frame of input data (or more simply, a frame of data), and, when display 1000 is operating in the oscilloscope mode to display data acquired at DAQ device 104, for each input channel to be displayed, display 1000 may visually present an amount of data referred to herein as a half-frame of input data (or more simply, a half-frame of data).

In accordance with another embodiment in which display 300 is operable to display data from DAQ device 104 while operating in an oscilloscope mode, for each input channel to be displayed, display 300 may visually present one frame of data, and, when display 1000 is operating in the oscilloscope mode to display data acquired at DAQ device 104, for each input channel to be displayed, display 1000 may also visually present one frame of input data.

Display 300 may comprise a touch screen that can detect the presence and location of a touch within its display area. The various menu items of a displayed menu may be selected via the touch screen.

User controls 306 are operable to enter a user-selection. User controls 306 may be arranged in various ways. In that regard, user controls 306 may be arranged to include a keypad, rotary switches, push buttons, or some other means to enter a user-selection. In the example embodiment illustrated in FIG. 3, user controls 306 include a power button 308, a brightness button 310, a keyboard button 312, a camera button 314, a cursor left button 316, a cursor right button 318, a cursor up button 320, a cursor down button 322, a menu item selection button 324, and a quick access button 326. Table 1 lists example user-selections that can be entered by pushing or pushing and releasing a user control of user controls 306. One or more of the user-selections can comprise selecting a zoom outward display mode in which display 300 displays data from more data frames than the number of data frames currently used to provide the data being displayed. Similarly, one or more of the user-selections can comprise selecting a zoom inward display mode in which display 300 displays data from fewer data frames than the number of data frames currently used to provide the data being displayed. Other examples of user controls 306 and other examples of the user-selections are also possible.

TABLE 1

| User Control | Example User-selections |
|---|---|
| Power button 308 | Turn display device 108 power on or off. |
| Brightness button 310 | Increase or decrease a brightness of display 300. Display a brightness menu at display 300. |
| Keyboard button 312 | Display keyboard at display 300. Remove keyboard being displayed at display 300. |
| Camera button 314 | Activate camera shutter to capture an image |
| Cursor left button 316 | Move a cursor, displayed at display 300, to the left |
| Cursor right button 318 | Move a cursor, displayed at display 300, to the right |
| Cursor up button 320 | Move a cursor, displayed at display 300, upward |
| Cursor down button 322 | Move a cursor, displayed at display 300, downward |
| Menu item selection button 324 | Select a menu item from displayed menu data 216. |
| Quick access button 326 | Select a function that pertains to a current operating mode of display device 108. |

Next, FIG. 4 illustrates a back view of an example embodiment of display device 108. FIG. 4 further illustrates that display device 108 includes (i) a stylus 400 that is operable to enter a user selection by touching display 300, (ii) a camera shutter 402, (iii) a camera flashing device 404, (iv) a lock slot 406, and (v) a device stand 408. Stylus 400 may be removed from a back side of display device 108 when a user desires to use stylus 400 to touch the touch screen of display 300, and stylus 400 may be reinserted into the back side of display device 108 when stylus 400 is not being used.

Next, FIG. 5 illustrates a block diagram of DAQ device 104, and FIG. 6 to FIG. 10 illustrate details of an example embodiment of DAQ device 104. As illustrated in FIG. 5, DAQ device 104 includes a user interface 900, a wireless transceiver 902, a processor 904, an input element 906, and a data storage device 908, all of which may be linked together via a system bus, network, or other connection mechanism 910.

User interface 900 is operable to present data to a user and to enter user inputs (e.g., user selections such as mode selections, sub-mode selections, a remote-control mode selection, and a local-control mode selection). User interface 900 may include display 1000 (shown in FIG. 7). Display 1000 is operable to visually present data, such as data obtained and/or generated by input element 906, data obtained via wireless transceiver 902, and/or data contained in data storage device 908. User interface 900 may include a selector device for selecting one or more modes and/or sub-modes of DAQ device 104 and for selecting between a local-control mode and a remote-control mode of DAQ device 104. Example selector devices 1002, 1004, 1006, 1008, 1010, 1012, 1014, 1016, and 1018 are illustrated in FIG. 7.

Wireless transceiver 902 may comprise a single wireless transceiver that is operable to carry out communications via wireless network 110. Wireless transceiver 902 may carry out communications with vehicle scanner 106, display device 108, and/or some other device that is operating to communicate via wireless network 110. As an example, wireless transceiver 902 may comprise a Bluetooth transceiver, a Wi-Fi transceiver, or some other type of wireless transceiver.

Alternatively, wireless transceiver 902 may comprise multiple wireless transceivers. For example, wireless transceiver 902 may comprise two wireless transceivers that communicate according to a common air interface protocol or different air interface protocols. Those air interface protocols may be selected from a Bluetooth air interface protocol, a Wi-Fi air interface protocol, and some other air interface protocol. In accordance with an embodiment in which wireless transceiver includes two transceivers, a Bluetooth transceiver may communicate with vehicle scanner 106 and/or display device 108 via a Bluetooth network of wireless network 110, and a Wi-Fi transceiver may communicate with vehicle scanner 106 and/or display device 108 via a Wi-Fi network of wireless network 110.

As another example, wireless transceiver 902 may include three or more wireless transceivers. In accordance with an embodiment in which wireless transceiver 902 includes three or more wireless transceivers, two or more of the wireless transceivers may communicate according to a common air interface protocol or different air interface protocols.

Processor 904 may comprise one or more general purpose processors (e.g., INTEL microprocessors) and/or one or more special purpose processors (e.g., digital signal processors). Processor 904 may execute computer-readable program instructions (CRPI) 918 that are contained in computer-readable data storage device 908.

Input element 906 may include input leads 912, an input signal processing element 914 that is operable to convert input signals obtained via input leads 912 into input data (e.g., generate input data), and packet element 916. Input leads 912 may include one or more input leads, each of which can receive input signals from an input signal acquisition point. The input signal acquisition point may comprise any of a variety of locations at which an input signal can be acquired. In accordance with an example in which device-under-service 102 comprises an automobile, the input signal acquisition point may comprise a location on the automobile at which a voltage signal, current signal, air pressure signal, air temperature signal, oil pressure signal, oil temperature signal, or some other input signal can be acquired.

Each input lead 912 may include a first end and a second end. The first end of each input lead 912 may be inserted into or otherwise attached to DAQ device 104. The first end of each input lead may comprise a banana plug. The second end of each input lead 912 may be arranged in any of a variety of configurations. As an example, a configuration of the second end may comprise a configuration that includes (i) an alligator clip, such as an MTA85 alligator clip sold by Snap-on Incorporated, Kenosha, Wis., United States, (ii) a spring hook, such as an MTA80 spring hook sold by Snap-on Incorporated, (iii) a test probe, such as an MTA20 test probe sold by Snap-on Incorporated, or (iv) a backprobe, such as an MTTL7005 backprobe sold by Snap-on Incorporated. Other example configurations of the second end of an input lead 912 are also possible.

Figure 6:
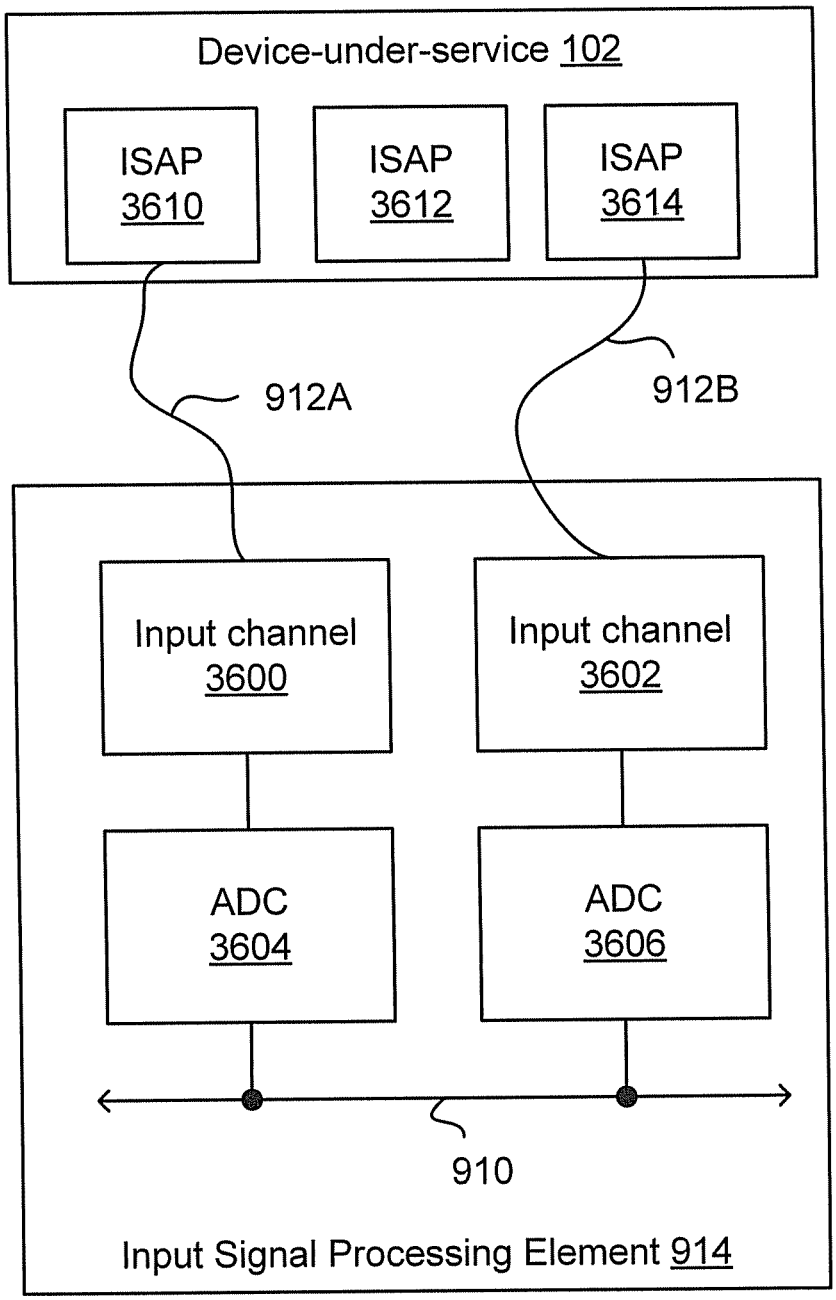
FIG. 6 is a block diagram illustrating details of the system shown in FIG. 1.

Input element 906 may include an input signal processing element 914 that is operable to convert an input signal received via one or more input leads 912 into input data that is displayable at display 1000. Each of those input signals may, for example, comprise analog electrical signals. FIG. 6 is a block diagram illustrating details of input signal processing element 914, examples of input leads 912, and details of device-under-service 102. As shown in FIG. 6, input signal processing element 914 includes input channels 3600 and 3602, analog-to-digital converter (ADC) 3604, and ADC 3606. Input channel 3600 may be associated with port 1022 (shown in FIG. 7) and input channel 3602 may be associated with port 1024 (shown in FIG. 7). The input channels may be operational when selector device 1002 is in a position such that DAQ device 104 operates in an oscilloscope mode.

In an alternative embodiment, input signal processing element 914 may include only one input channel (e.g., input channel 3600 or 3602) or may include more than two input channels (e.g., input channels 3600 and 3602 and at least one other input channel). Each of the at least one other input channel may associated with (i) a respective port (not shown) to which an input lead (connectable to an ISAP) can be connected, and (ii) a respective ADC (not shown). Digital outputs of ADC 3604 and 3606 and other ADC associated with a DAQ device input channel may be transferred to another element of DAQ device 104 (e.g., user interface 900, processor 904, data storage 908, or packet element 916) via connection mechanism 910.

Input signal processing element 914 is not limited to two input channels and two ADC. For instance, input signal processing element 914 may comprise four input channels and a respective ADS for each input channel. Other examples of the number of input channels and ADS included within input signal processing element 914 are also possible.

Device-under-service 102 may comprise a plurality of input signal acquisition points (ISAP). As shown in FIG. 6, device-under-service 102 comprises ISAP 3610, 3612, and 3614. Each ISAP may comprise a point at which an input signal can be acquired, such as a point comprising a terminal within an electrical connector, a point within a wiring harness carrying electrical signals, a battery lead, or some other point within device-under-service 102. Input leads 912 may include input lead 912A and input lead 912B. Input leads 912A and 912B can be connected to and removed from any of the various ISAP within device-under-service 102.

Returning to FIG. 5, packet-element 916 is operable to packetize the input data (e.g., place the input data into data packets) so as to generate data packets containing the input data. Packet-element 916 may provide the data packets to wireless transceiver 902 via connection mechanism 910 for subsequent transmission of the data packets via an air interface. In an alternative embodiment, processor 904 or some other portion of DAQ device 104 can comprise packet-element 916 or carry out the functions of packet-element 916. The data packets containing the input data may be carried as the payload of data-share message 3500 (shown in FIG. 12).

Data storage device 908 may comprise a non-transistory computer-readable storage medium readable by processor 904. The computer-readable storage medium may comprise volatile and/or non-volatile storage components, such as optical, magnetic, organic or other memory or disc storage, which can be integrated in whole or in part with processor 904. Data storage 908 may be arranged to include multiple buffers for storing input data, such as buffers 922A, 922B, and 922C (shown in FIG. 8 and FIG. 10). Data storage device 908 may contain various computer-readable data, such as CRPI 918, remote device data 920, input data 922, and instruction data 924.

Remote device data 920 may include data associated with a device that is arranged to communicate with DAQ device 104 via wireless network 110. For example, remote device data 920 may include data associated with display device 108, such as a radio identifier and password associated with display device 108. The data associated with display device 108 may be received at DAQ device 104, for storing as remote device data 920, during a pairing process carried out between display device 108 and DAQ device 104. The pairing process between DAQ device 104 and display device 108 may include DAQ device 104 providing display device 108 with the data (e.g., a passkey) associated with DAQ device 104 and display device 108 providing DAQ device 104 with data (e.g., a passkey) associated with display device 108. After carrying out that paring process with display device 108, DAQ device 104 may use the remote device data 920 when establishing communication network 110 with display device 108.

Input data 922 may comprise data generated by input signal processing element 914. A portion of data storage device 908 that contains input data 922 may function as a historical data buffer 922A (shown in FIG. 8 and FIG. 10). Once buffer 922A is filled with data, the first data stored in the buffer may be the first data overwritten such that buffer 922A follows a first-in-first-out (FIFO) process. Use of a selector device on DAQ device 104 may cause DAQ device 104 to enter a mode in which at least a portion of input data stored in buffer 922A is not overwritten by new input data (e.g., a portion of input data generated by input channel 1 or input channel 2). During this mode, the portion of the input data stored in buffer 922A not being overwritten can be displayed via display 1000 (or display 300) at the same time that live input data is being displayed via display 1000 (or display 300). Use of a selector device on DAQ device 104 may cause DAQ device 104 to exit the mode in which at least a portion of input data 922 is not overwritten by live input data.

Instruction data 924 may comprise data that identifies how to connect a portion of DAQ device 104 to device-under-service 102, how to operate device-under-service 102 (e.g., which position selector device 1002 should be turned to or which selector device of selector devices 1004-1008 should be pushed), inspections to carry out on device-under-service 102, or some other instruction data. Instruction data 924 may comprise various data including numbers, letters, punctuation marks, pictures, graphs, waveforms, or some other visually presentable form of data.

CRPI 918 may include program instructions (referred to herein as PI-918-A) that are executable to cause DAQ device 104 to transition from a local-control mode to a remote-control mode. Processor 904 may execute PI-918-A in response to selector device 1002 changing from a position associated with a DAQ mode that is selected via selector device 1002 to a position associated with the remote-control mode. Alternatively, processor may execute PI-918-A in response to engaging a selector device (e.g., selector device 1004) or by a changing a selector device from a local-control mode position to a remote-control mode position. Execution of PI-918-A may cause a transceiver or transceivers of wireless transceiver 902 to transition from a transceiver-off state to a transceiver-on state.

CRPI 918 may include program instructions (referred to herein as PI-918-B) that are executable to change an operating state of wireless transceiver 902 from a remote-control mode to a local-control mode. Processor 904 may execute PI-918-B in response to selector device 1002 changing from position associated with the remote-control mode to a position associated with a DAQ mode that is selected via selector device 1002. Alternatively, processor may execute PI-918-B in response to engaging a selector device (e.g., selector device 1004) or by changing a selector device from a remote-control mode position to a local-control mode position. Execution of PI-918-B may cause a transceiver or transceivers of wireless transceiver 902 to transition from a transceiver-on state to a transceiver-off state.

CRPI 918 may include program instructions (referred to herein as PI-918-C) that are executable to determine a desired mode for DAQ device 104 from mode-selection command 3400. If DAQ device 104 is operating in the mode identified in mode-selection command 3400, execution of PI-918-C allows DAQ device 104 to continue operating in the desired mode. On the other hand, if DAQ device 104 is operating in a mode different than the mode identified in mode-selection command 3400 (i.e., a non-desired mode), execution of PI-918-C causes DAQ device 104 to transition from operating in the non-desired mode to the desired mode.

CRPI 918 may include program instructions (referred to herein as PI-918-D) that are executable to cause display 1000 to display instruction data 924. In one respect, execution of PI-918-D may cause display 1000 to display instruction data 924 so as to guide a user in connecting input leads 912 to device-under-service 102. In another respect, execution of PI-918-D may cause display 1000 to display instruction data (such as instruction data 218) that is received as payload in data-share message 3500.

CRPI 918 may include program instructions (referred to herein as PI-918-E) that are executable to cause input data generated by input element 906 to be transmitted to wireless network 110 for transmission, in turn, to display device 108. The input data may be packetized by packet element 916 prior to being transmitted. Wireless transceiver 902 transmits the input data to wireless network 110, and may do so using messages arranged like data-share message 3500 or some other message. Execution of PI-918-E may occur in response to DAQ device 104 receiving an input data request message 1200. Execution of PI-918-E may include determining which input data, based on the input data request message 1200, is to be transmitted to display device 108.

Next, FIG. 7 illustrates a front view of an example embodiment of DAQ device 104, and in particular, elements of user interface 900 and input element 906. The elements of user interface 900 may include display 1000 and selector devices 1002, 1004, 1006, 1008, 1010, 1012, 1014, 1016, and 1018. For purposes of this description, "selector devices 1004-1018" refers to selector devices 1004, 1006, 1008, 1010, 1012, 1014, 1016, and 1018. FIG. 7 also illustrates (i) ports 1020, 1022, and 1024, which are part of input element 906, and (ii) a grip 1026 that provides DAQ device 104 with shock protection in the event that DAQ device 104 is dropped or struck.

Display 1000 may comprise a liquid crystal display (LCD), a plasma display, or some other type of display. Display 1000 is operable to visually present (e.g., display) data to a user. Display 1000 may visually present data using numbers, letters, punctuation marks, pictures, graphs, waveforms, or some other visually presentable form of data. The data visually presentable and/or presented at display 1000 may include locally-acquired data (LAD), such as data acquired via input element 906 (e.g., via input leads 912) and/or data contained in data storage device 908. The data visually presentable and/or presented at display 1000 may include remotely-acquired data (RAD), such as data acquired via wireless transceiver 902.

Selector device 1002 comprises a switch having multiple positions. As illustrated in FIG. 7, selector device 1002 comprises a rotary switch having nine positions, but selector device 1002 is not so limited. Each position of selector device 1002 is associated with an off mode or one or more data acquisition modes, and each position of selector device 1002 is associated with one or more symbols to identify the mode(s) associated with that position. Furthermore, each position of selector device 1002 may be associated with a local-control mode (e.g., a mode in which the off mode or data acquisition mode is selected by selector device 1002) or a remote-control mode (e.g., a mode in which a data acquisition mode is selected by display device 108).

Table 2 provides an example list of modes associated with each position of selector device 1002, and an example list of whether each position is associated with a local-control mode or a remote-control mode.

TABLE 2

| Position of selector device 1002 | Mode Control Type | Mode |
|---|---|---|
| Position 1 | Local-Control Mode | Off mode |
| Position 2 | Local-Control Mode | Volts DC mode |
| Position 3 | Local-Control Mode | Volts AC mode |
| Position 4 | Local-Control Mode | Resistance mode |
| Position 5 | Local-Control Mode | Diode/Continuity mode |
| Position 6 | Local-Control Mode | Auxiliary mode |
| Position 7 | Local-Control Mode | Capacitance mode |
| Position 8 | Local-Control Mode | Oscilloscope mode |
| Position 9 | Remote-Control Mode | DAQ mode selected via display device 108 |

Position 1 is associated with the symbol "OFF." The position numbers increase in a clockwise direction. The three circles on selector device 1002 are closest to a currently-selected position. In FIG. 7, position 2 is the currently-selected position.

Selector device 1002 may be turned to each of the nine positions. Turning selector device 1002 from a first position (not necessarily position 1) to a second position (not necessarily position 2) can cause DAQ device 104 to transition from a first DAQ mode that is associated with the first position to a second DAQ mode that is associated with the second position. Transitioning from the first DAQ mode to the second DAQ mode may be carried out, at least in part, by processor 904 executing program instructions of CRPI 918.

While selector device 1002 is positioned at a position corresponding to a remote-control mode (e.g., position 9), wireless transceiver 902 may receive a mode-selection command transmitted from display device 108. The mode-selection command may be received in response to wireless transceiver 902 transmitting to display device 108 a request for a mode-selection command. The mode-selection command received at wireless transceiver 902 may be arranged as mode-selection command 3400 illustrated in FIG. 11. Mode-selection command 3400 may include a mode field 3406 that identifies a DAQ mode selected via display device 108. The DAQ mode selected via display device 108 may comprise a mode that is also selectable via DAQ device 104. Mode field 3406 may identify a sub-mode selected via display device 108. The sub-mode selected via display device 108 may comprise a sub-mode that is also selectable via one of selector devices 1004-1018 when selector device 1002 is in a local-control mode position. Table 3 identifies example modes and sub-modes that can be identified in mode field 3406.

TABLE 3

| Position of selector device 1002 | Mode | Sub-mode |
|---|---|---|
| 9 | Volts DC mode | Range 0-2 Volts |
| 9 | Volts AC mode | Range 0-20 Volts |
| 9 | Resistance mode | N.A. |
| 9 | Diode/Continuity mode | N.A. |
| 9 | Auxiliary mode | Temperature mode, vacuum mode, air pressure mode, oil pressure mode, or current mode |
| 9 | Capacitance mode | N.A. |
| 9 | Oscilloscope mode | N.A. |

Selector devices 1004-1018 may each comprise a respective push button, but selector devices 1004-1018 are not so limited. Each selector device of selector devices 1004-1018 may be pushed or pushed and released to enter a user input that triggers a function, associated with that selector device, to be initiated and/or carried out. In this description, pushing a selector device refers to pushing a selector device or pushing and releasing a selector device.

One or more of selector devices 1004-1018 may be associated with multiple modes multiple sub-modes, and or functions. For example, selector devices 1004, 1006, 1008, and 1110 may be associated with a respective first sub-mode while selector device 1002 is positioned at position 2 and may be associated with a respective second sub-mode while selector device 1002 is positioned at a position other than position 1 or position 2.

The function associated with each selector device of selector devices 1004-1018 may be dependent upon the position of selector device 1002. As an example, when selector device 1002 is in position 8 and DAQ device 104 is operating in the oscilloscope mode, selector device 1004 may be pushed to enter a user input that causes an input signal at an input channel to be tagged as a historical waveform to be displayed for that input channel, and selector device 1006 may be pushed to enter a user input that causes an input signal at another input channel to be tagged as a historical waveform to be displayed for that other input channel. When selector device 1002 is in positions other than position 8, pushing selector device 1004 and 1006 may trigger other functions to be carried out.

One or more of selector devices 1004-1018 may be associated with a remote-control mode. For instance, selector device 1004 may associated with a remote-control mode. In that regard, pushing selector device 1004 may cause DAQ device 104 to transition from a local-control mode to a remote-control mode in the same way as if selector device 1002 is moved to position 9. Pushing that same selector device or another selector device, while DAQ device 104 operates in the remote-control mode, may cause DAQ device 104 to transition from the remote-control mode to a local-control mode in the same way as if selector device 1002 is moved from position 9 to another position.

Ports 1020, 1022, and 1024 are operable to receive a respective input lead of input leads 912. Each input lead can include first and second ends. The first end of an input lead may comprise a banana plug. Ports 1020, 1022, and 1024 may include a respective female banana plug receptacle for receiving the banana plug of an input lead. The second end of each input lead may include an alligator clip, a quick-attach probe, or some other device for contacting an input signal acquisition point.

Figure 8:
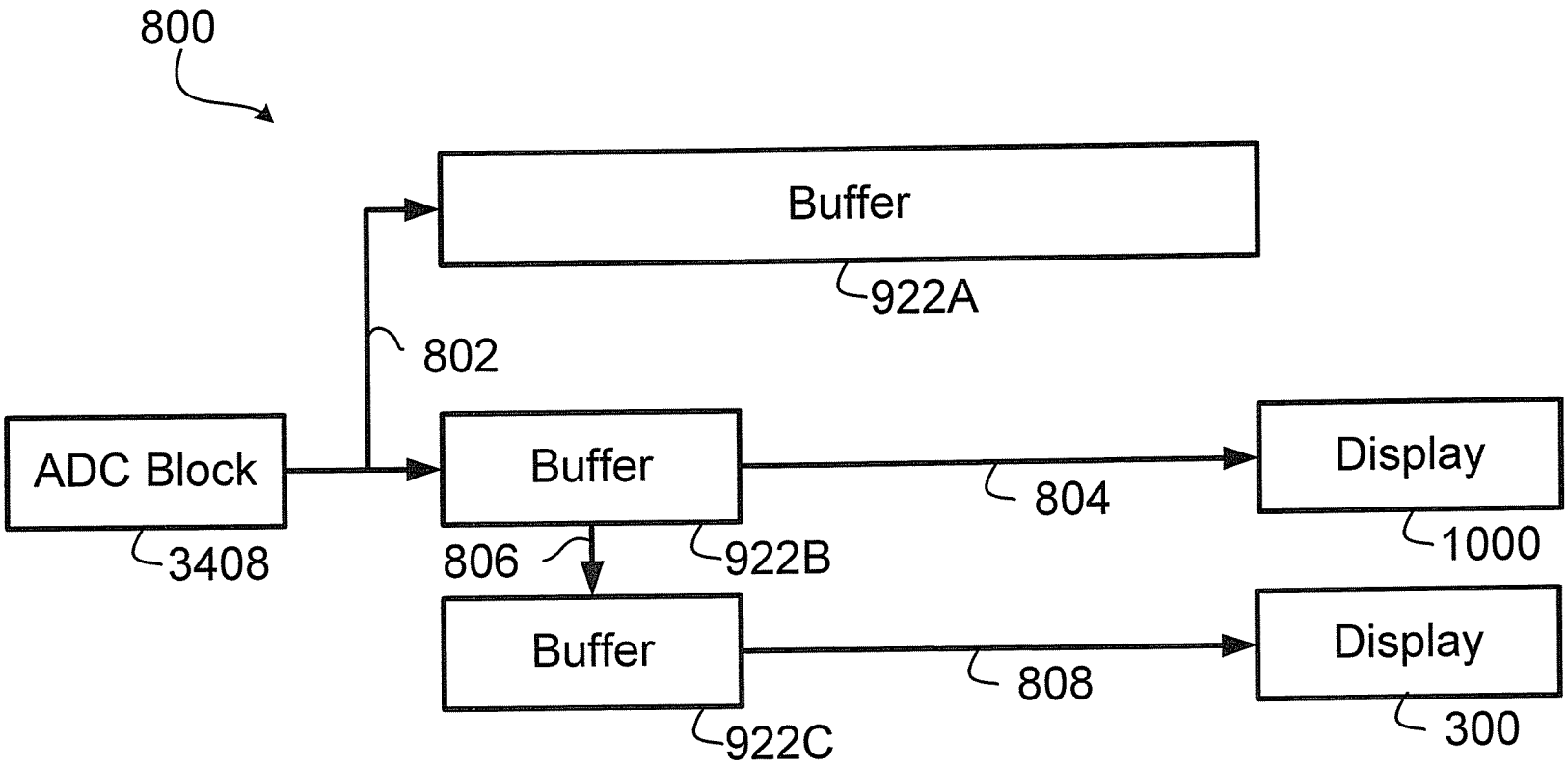

Next, FIG. 8 illustrates a block diagram of an example system arrangement 800 for carrying out example embodiments described herein. System arrangement 800 includes analog-to-digital (ADC) block 3408, buffers 922A, 922B, and 922C, displays 300 and 1000, and communications links 802, 804, 806, and 808. In accordance with an example embodiment, ADC block 3408, buffers 922A, 922B, 922C, communication links 802, 804 and 806, display 1000, and a portion of communication link 808 are located at and/or within DAQ device 104.

System arrangement 800 may be used when the input channels of DAQ device 104 (e.g., input channels 3600 and 3602) are receiving input data for displaying at a fast sweep speed. A sweep speed is a rate at which an oscilloscopes electron beam moves across display 300 or display 1000 from one side to the other side (e.g., left side to right side). As an example, a fast sweep speed may be a sweep speed greater than or equal to 500 milliseconds (ms) per division. The division could be multiple divisions displayed on displays 300 and 1000 when DAQ device 104 and display device 108 are operating in an oscilloscope mode. A slow sweep speed may be a sweep speed less than 500 ms/division. Alternatively, the sweep speed could be the amount of time for the electron beam to traverse the entire display from side to side (i.e., all divisions if divisions are displayed on displays 300 and/or 1000).

ADC block 3408 may include one or more analog-to-digital converters, such as ADC 3604 and ADC 3606. ADC block 3408 may also include a bit converter for converting numeric words having a first number of data bits to numeric words having a second number of data bits. For example, ADC 3604 and ADC 3606 may comprise analog-to-digital converters with a 10-bit resolution and ADC block 3408 may comprise a converter to convert 10-bit words output from ADC 3604 and ADC 3606 to 8-bit words. The conversion from a larger bit word (e.g., a 12-bit word or a 10-bit word) to a smaller bit word (e.g., an 8-bit word) may be carried out if buffers 922A, 922B, and 922C are arranged for storing the smaller bit words and/or if displays 300 and 1000 are arranged for displaying the smaller bit words.

In system arrangement 800, buffers 922A and 922B may receive input data generated from ADC block 3408 via communication link 802 (e.g., a portion of connection mechanism 910). Buffer 992A is a large buffer relative to buffer 922B in that buffer 992A can store more frames of input data generated by ADC block 3408. As an example, a frame of input data may comprise a quantity of data bytes of input data necessary to refresh display 1000 (e.g., to update display 1000 with a new waveform for one input channel).

For purposes of this description, a frame comprises 580 data bytes. A person having ordinary skill in the art will understand, however, that a frame could be defined to include a number of data bytes other than 580 bytes, as well as that a frame of input data could comprise a quantity of data bytes of input data necessary to refresh a different display (e.g., display 300). For an embodiment in which a frame comprises 580 data bytes, a half-frame comprises 290 data bytes, a quarter-frame comprises 145 data bytes, and 2 frames comprise 1160 data bytes.

As an example, buffer 922A can be arranged for storing 500 frames of input data for both of input channels 3600 and 3602. Alternatively, buffer 922A can be arranged to store a different quantity of frames of input data for input channels 3600 and 3602. Two of the frames of input data stored in buffer 922A for each of input channels 3600 and 3602 may comprise the most-recently generated input data generated by ADC block 3408. The other frames of input data stored in buffer 922A can comprise frames of input data generated by ADC block 3408 prior to the most-recently generated input data. For purposes of this description, those other frames of input data are referred to as historical frames of input data. In an alternative arrangement, buffer 922A may only store historical frames of input data.

Buffer 922B can be arranged for storing 2 frames of input data for each input channel (i.e., one or more input channels) of DAQ device 104. Buffer 922B can be repeatedly refreshed with the 2 frames of the most-recently generated input data for each input channel that is currently receiving an input signal. The most-recently generated input data stored in buffer 922B can be received from ADC block 3408 via communication link 802. Additionally, buffer 922B can be refreshed to store historical frame of input data instead of the most-recently generated input data. The historical frames of input data stored in buffer 922B can be received from buffer 922A via communication link 802 or another communication link (not shown).

In system arrangement 800, buffer 922C may receive input data from buffer 922B via communication link 806. In this regard, the input data stored in buffer 922C can comprise most-recently generated input data or historical input data. Buffer 922C can be arranged to store 2 frames of input data for each input channel (i.e., one or more input channels) of DAQ device 104 or some amount of input data less than 2 frames of input data for each input channel of DAQ device 104. For an embodiment in which the DAQ device comprises two input channels 3600 and 3602, the input data provided to buffer 922C may be for the input channels that are currently receiving input signals. For embodiments in which the DAQ device comprise more than two input channels, again, the input data provided to buffer 922C may be for those input channels that are currently receiving input signals.

Figure 12:
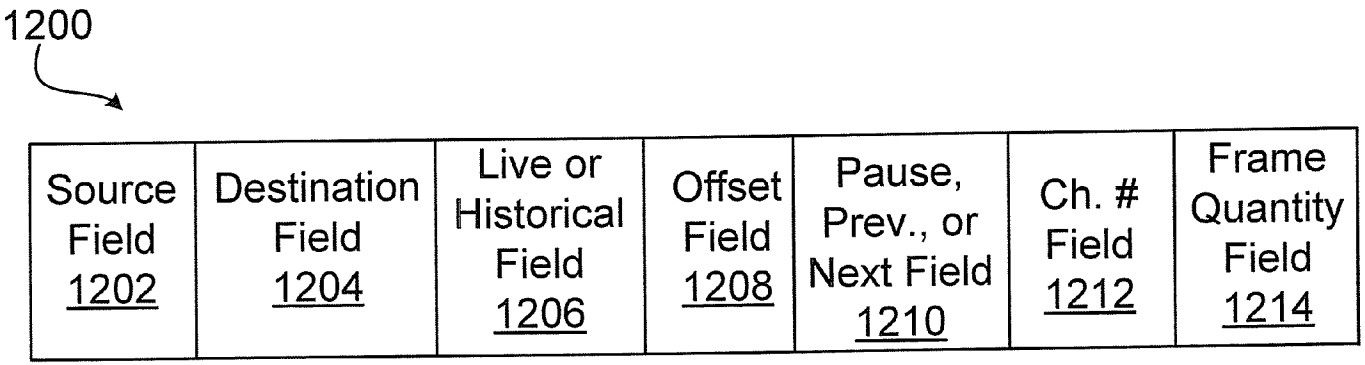

The input data stored in buffer 922C may be transmitted to display device 108 via communication link 808. Communication link 808 may include portions of connection mechanisms 210 and 910 and wireless network 110. The contents of buffer 922C may be transmitted to display device 108 in response to DAQ device 104 receiving an input data request message 1200 (as illustrated in FIG. 12). The input data transmitted to display device 108 via communication link 808 may subsequently be displayed at display 300.

Buffer 922B may provide data to buffer 922C in response to various trigger events. In one respect, buffer 922B may provide input data to buffer 922C in response to DAQ device 104 receiving input data request messages 1200. In another respect, buffer 922B may provide input data to buffer 922C each time new input data is provided to buffer 922C. Other example trigger events that cause buffer 922B to provide data to buffer 922C are also possible.

Next, FIG. 9 illustrates an example arrangement for storing input data in buffer 922B. In accordance with the example arrangement, buffer 922B is operable to store 2 frames of input data for each input channel of DAQ device 104. In that regard, buffer 922B can store 2,320 data bytes. Sequential buffer data byte numbers are shown in the left-most column in FIG. 9. The buffer data byte numbers 9 through 1158 and 1163 through 2314 are not shown in FIG. 9 but are represented by the periods in the column. Each of the data bytes within buffer 922B may be associated with a hexadecimal data address. For simplicity, those data addresses are shown (in the second column from the left) as starting at hexadecimal address 0000 and ending at hexadecimal address 0910. As an example, each byte of data stored in buffer 922A, as well as in buffers 922B and 922C, may represent a voltage amplitude displayable as a single point of an oscilloscope waveform.

The three right-most columns in FIG. 9 illustrate that the input data stored within buffer 922B is interleaved (e.g., the input data for input channels 1 and 2 is stored in an alternating fashion) (i.e., channel 1, channel 2, channel 1, channel 2, and so on).

Figure 10:
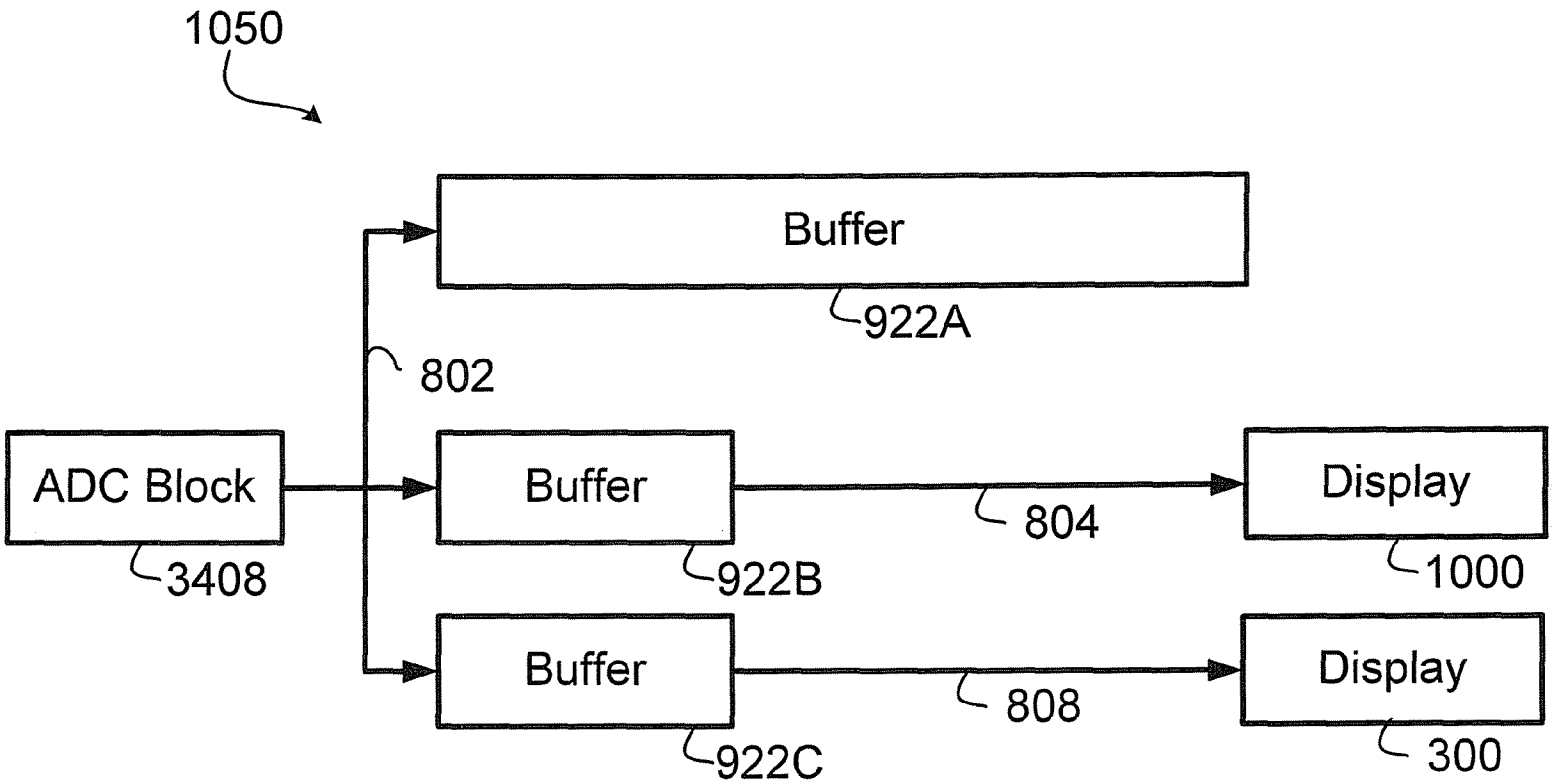

Next, FIG. 10 illustrates a block diagram of an example system arrangement 1050 for carrying out example embodiments described herein. System arrangement 1050 is similar to system arrangement 800 except that communication link 806 is not used to transfer data from buffer 922B to 922C, and communication link 802 provides a link for buffer 922C to receive input data directly from ADC block 3408. System arrangement 1050 may be used when the input channels of DAQ device 104 are receiving input data for display data at a slow sweep speed. In accordance with system arrangement 1050, buffer 922C may be refreshed with input data in the same manner that buffer 922B is refreshed with input data, and input data contained in buffer 922C may be provided to display 300 in the same manner that the input data is provided to display for system arrangement 800.

Figure 19:
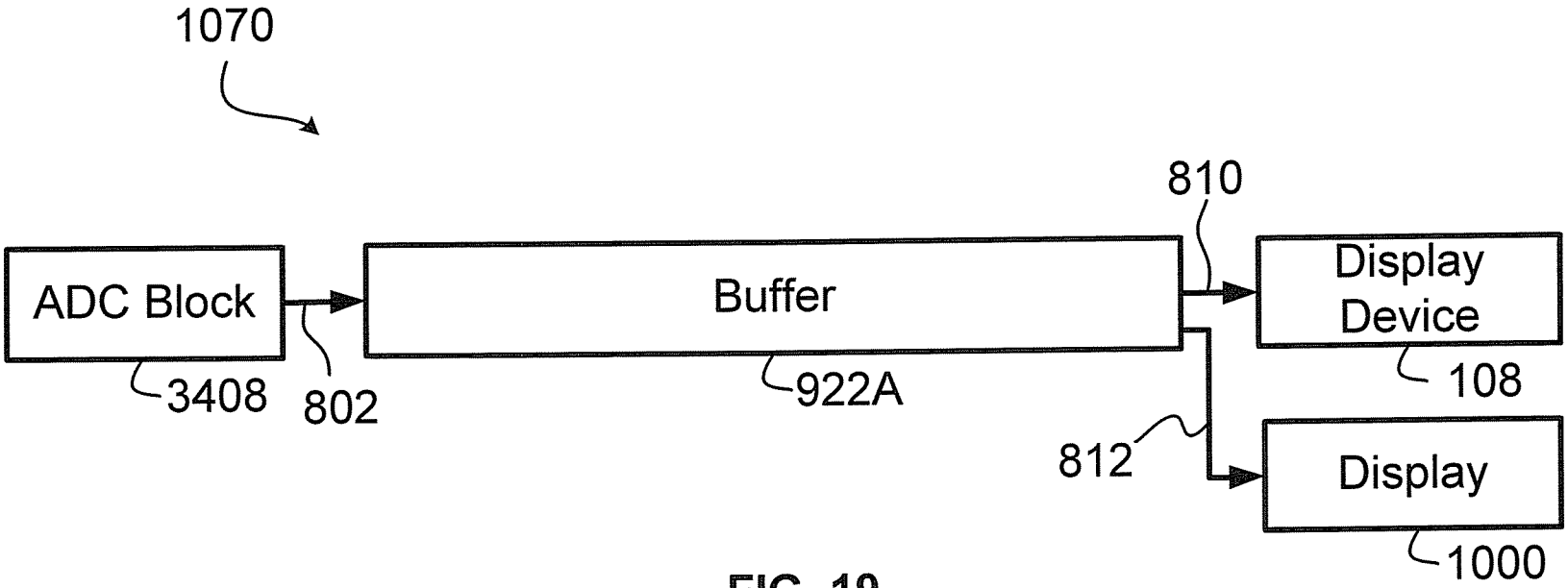
FIG. 19 illustrates additional details of the DAQ device of FIG. 5.

Next, FIG. 19 illustrates an example system arrangement 1070 for carrying out example embodiments described herein. System arrangement 1070 may, for example, be used when displaying historical input data at display 300 and/or in response to pause selector 1708 being selected to pause a waveform being displayed on display 300, as well as when displaying historical input data at display 1000. System arrangement 1070 includes a communication link 810 for providing one or more frames from buffer 922A to display device 108, and a communication link 812 for providing one or more frames from buffer 922A to display 1000.

Transmission of multiple frames of data via communication link 810 may increase throughput of system 100 as the multiple frames of data may be sent in response to DAQ 104 receiving a single input data request message 1200 rather than individual requests for each of the multiple frames of data. Transmission of multiple frames of data via communication link 812 may increase throughput of system 100.

Figure 20:
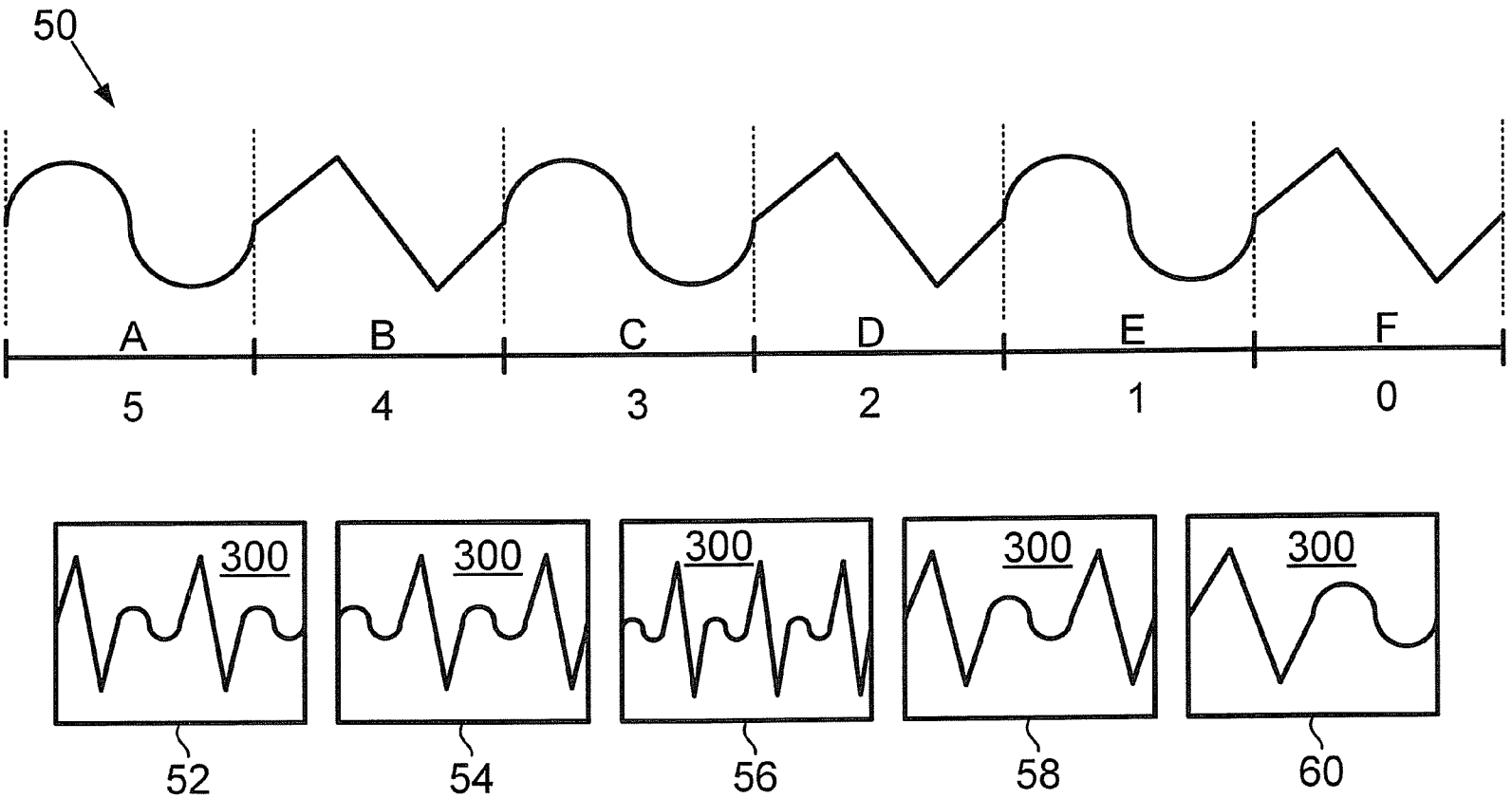
FIG. 20 illustrates an example waveform that can be received at an input channel of a DAQ device 104 and examples of displayed input data that can be generated from data stored in a buffer in response to the input channel receiving the waveform.

Next, FIG. 20 illustrates an example waveform 50 that can be received at an input channel (e.g., input channel 3600) of DAQ device 104 and examples of displayed input data 52, 54, 56, 58, and 60 that can be generated from data stored in buffer 922A in response to the input channel receiving waveform 50. Waveform 50 corresponds to 6 frames of data (or more simply, frames) identified by the letters A, B, C, D, E, and F. The numbers 5, 4, 3, 2, 1, and 0 below the frame identifiers A, B, C, D, E, and F, respectively, indicate an offset from frame F. Frame F may be the most-recently obtained frame of input data. Waveforms received at other input channels of DAQ device 104 can cause other data to be stored in buffer 922A as well.

Displayed input data 52 to 60 are illustrated as being displayed via display 300 of display device 108. Additionally or alternatively, displayed input data 52 to 60 could be displayed via display 1000 of DAQ device 104. The displayed input data 52 to 60 illustrate frames of data being displayed in a zoom mode in which the displayed data represents more than 1 frame of data stored in buffer 922A. Table 4 identifies example data that can be included within input data request message 1200 in order to receive multiple frames of data for displaying displayed input data 52 to 60 at display device 108. The 4 frames of displayed input data 52 are frames B, C, D, and E. The 4 frames of displayed input data 54 can be frames C, D, E, and F or frames A, B, C, and D. The 6 frames of displayed input data 56 are frames A to F. The 3 frames of displayed input data 58 can be frames D, E, and F or frames B, C, and D. The 2 frames of displayed input data 60 can be frames D and E or B and C.

TABLE 4

| Displayed Data in FIG. 20 | Field 1202 of Message 1200 | Field 1204 of Message 1200 | Field 1206 of Message 1200 | Field 1208 of Message 1200 | Field 1210 of Message 1200 | Field 1212 of Message 1200 | Field 1214 of Message 1200 |
|---|---|---|---|---|---|---|---|
| 52 | Display Device 108 | DAQ Device 104 | Historical | 1 | Pause | 3600 | 4 |

TABLE 4-continued

| Displayed Data in FIG. 20 | Field 1202 of Message 1200 | Field 1204 of Message 1200 | Field 1206 of Message 1200 | Field 1208 of Message 1200 | Field 1210 of Message 1200 | Field 1212 of Message 1200 | Field 1214 of Message 1200 |
|---|---|---|---|---|---|---|---|
| 54 | Display Device 108 | DAQ Device 104 | Historical | 0 | Pause | 3600 | 4 |
| 54 | Display Device 108 | DAQ Device 104 | Historical | 2 | Pause | 3600 | 4 |
| 56 | Display Device 108 | DAQ Device 104 | Historical | 0 | Pause | 3600 | 6 |
| 58 | Display Device 108 | DAQ Device 104 | Historical | 0 | Pause | 3600 | 3 |
| 58 | Display Device 108 | DAQ Device 104 | Historical | 2 | Pause | 3600 | 3 |
| 60 | Display Device 108 | DAQ Device 104 | Historical | 1 | Pause | 3600 | 2 |
| 60 | Display Device 108 | DAQ Device 104 | Historical | 3 | Pause | 3600 | 2 |

After display device 108 receives multiple frames of data in response to input data request message 1200, processor 204 may execute CRPI 212 to compress the multiple received frames to the number of frames (e.g., 1 frame) displayable via display 300. As an example, when X number of frames are requested to be displayed and each frame of data comprises 590 data bytes, CRPI 212 may take the average of every X sequential bytes (without summing any individual data byte more than once) within the number of frames to be displayed to compress the X times 590 data bytes down to 590 data bytes. The resulting 590 data bytes can be provided to display 300. If X=4 and the requested input channel is channel 1, referring to FIG. 9, the first data byte of the resulting 590 data bytes would equal the average of the data bytes at data addresses 0000, 0002, 0004, and 0006.

Additionally or alternatively, CRPI 918 may include program instructions executable by processor 904 at DAQ device 104 to compress frames of data, such as multiple frames of data stored within buffer 922A. Compressing multiple frames of data at DAQ device 104 can further increase throughput of system 100 as the compressed frames can be transmitted to display device 108 in response to a single request for multiple frames of data. For example, transmission of 500 compressed frames requires less bandwidth than transmission of 500 non-compressed frames.

Although DAQ device 104 is operable to compress frames of data stored in buffer 922A, in some instances, it is desirable to transmit multiple non-compressed frames of data from DAQ device 104 to display device 108 and to compress the frames at display device 108 instead of at DAQ device 104. The non-compressed multiple frames of data received by display device 108 from DAQ device 104 can be stored as input data 922. If the received frames comprise 500 frames, a user may zoom out to display 250 of the received frames, then zoom out further to display 300 of the received frames, and then zoom out even further to display 400 of the received frames. Each time the user selects a different zoom, processor 904 can execute CRPI 918 to compress the frames stored as input data 922 without having to send another request for frames from buffer 922A.

Furthermore, the 500 non-compressed frames can be contained as input data 922 even after buffer 922A has been overwritten with other frames of data, and user interface 200 can be operated to associate tags with each set of frames stored as input data for quicker location and retrieval of the stored frames. For example, a set of stored frames can be associated with tags to identify the frames as a fuel injector waveform for a model year 2011 Chevrolet Camaro with a 6.2 Liter V-8 engine operating at 2,500 RPM. That set of stored frames can be retrieved and displayed at display 300 even though none of the components of system 100 are connected to the particular vehicle from which data was captured to generate the 500 frames and/or the 500 frames are no longer contained in buffer 922A. Input data 922 can store multiple sets of multiple frames received from DAQ device 104, each set being received in response to a single respective request for multiple frames and associable with tags to identify the frames.

III. Example Communications

A variety of communications may be carried out via wireless network 110. Examples of those communications are illustrated in FIG. 11 to FIG. 14.

Figure 11:
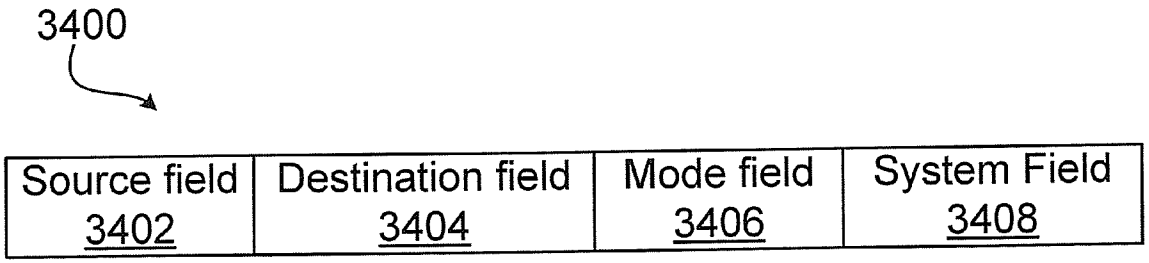
FIG. 11 to FIG. 14 illustrate example communications sent by one or more devices shown in FIG. 1.

FIG. 11 illustrates an example mode-selection command 3400. Mode-selection command 3400 may comprise one or more data fields. As illustrated in FIG. 11, the data fields include a source field 3402, a destination field 3404, a mode field 3406, and a system field 3408. Source field 3402 may include an identifier of a device that generates and/or transmits mode-selection command 3400 (e.g., display device 108). Destination field 3404 may include an identifier of a destination device that is the destination for mode-selection command 3400 (e.g., DAQ device 104) or identifiers of a plurality of destination devices that are the destinations for mode-selection command 3400 (e.g., DAQ device 104 and vehicle scanner 106).

Mode field 3406 may include an identifier of a desired operating mode for the device or devices identified by destination field 3404. If the destination device is DAQ device 104, the desired mode identified by mode field 3406 may comprise a DAQ mode associated with one of positions 1 though 8 of selector device 1002. For instance, the desired mode may comprise the oscilloscope mode.

System field 3410 may include an identifier of device-under-service 102 and/or a system contained at and/or within device-under-service 102. In accordance with an example embodiment in which device-under-service 102 comprises an automobile, such as a model year 2010 Chevrolet Camaro built by General Motors Corporation, Detroit, Mich., United States, the identifier of system field 3410 may comprise an identifier identifying device-under-service 102 as a 2010 Chevrolet Camaro and/or a system contained at and/or within a 2010 Chevrolet Camaro, such as an anti-lock brake system, a powertrain system, an HVAC system, a supplemental inflatable restraint (SIR) system, or some other system. Table 5 lists example system field information that may be contained in and/or represented by system field 3410.

TABLE 5

| System Field Information | | | Mode Field Information | |
|---|---|---|---|---|
| Model | | | | |
| Year | Manufacturer | Model | Sub-system | Parameter |
| 2010 | Chevrolet | Camaro | Transmission | Oil Temperature |
| 2010 | Chevrolet | Camaro | Engine | MAP sensor |
| 2009 | Chevrolet | Malibu | SIR | DTC |
| 2008 | Ford | Mustang | Engine | DTC |

If a device does not require information transportable via mode field 3406 or system field 3408, that field may be omitted from a mode-selection command to be transmitted to that device.

FIG. 12 illustrates an example input data request message 1200 that display device 108 may transmit to DAQ device 104 via wireless network 110. Input data request message 1200 may comprise a source field 1202 that identifies display device 108 as a source of message 1200, a destination field 1204 that identifies DAQ device 104 as a destination for message 1200, a live or historical data field 1206, an offset field 1208, a pause, previous, or next field 1210, a channel number field 1212, and a frame quantity field 1214.

Live or historical data field 1206 may comprise data that identifies whether a user of display device 108 wants to view live data (i.e., the most-recently received data) or historical data (i.e., data received at DAQ device prior to the most-recently received data).

Offset field 1208 may comprise a numeric value that identifies a number of data bytes to adjust a trigger point within buffer 922B. As an example, the trigger point within buffer 922B may comprise a virtual point between a portion of buffer 922B that stores the first frames of input data for the input channels of DAQ device 104 (i.e., frames numbered 1 and 2 in FIG. 9) and the second frames of input data for the input channels of DAQ device 104 (frames numbered 3 and 4 in FIG. 9). In this regard, referring to FIG. 9, the virtual point may be a point between buffer byte numbers 1160 and 1161. DAQ device 104 may identify the virtual point by one or more of data addresses 0487 and 0488.

Table 6 illustrates one-frame portions of input data, stored in buffer 922B, that can be sent to display device 108 in response to DAQ device 104 receiving input data request message 1200 with various offsets in offset field 1208 and the trigger point defined as the virtual point between buffer byte numbers 1160 and 1161. In Table 6, as the offset increases, one less byte from frame number 3 will be in included in the one-frame portion for channel number 1 and one additional byte from frame number 1 will be included in the one-frame portion for channel number 1. A person having ordinary skill in the art will understand that Table 6 could include example offsets 7 through 574 and the byte numbers of frame numbers 1, 2, 3, and 4 that are associated with those offsets using the same pattern for using one less byte from frame numbers 2 and 4 and one additional byte from frame numbers 1 and 3 as the offset increase. In Table 6, the symbols "●●●" represent the offsets 7-574 and associated byte numbers.

TABLE 6

| | Channel No. 1 | | Channel No. 2 | |
|---|---|---|---|---|
| Off-set | Bytes Numbers from Frame No. 1 | Bytes Numbers from Frame No. 3 | Bytes Numbers from Frame No. 2 | Bytes Numbers from Frame No. 4 |
| 0 | — | 1-580 | — | 1-580 |
| 1 | 580 | 1-579 | 580 | 1-579 |
| 2 | 579-580 | 1-578 | 579-580 | 1-578 |
| 3 | 578-580 | 1-577 | 578-580 | 1-577 |
| 4 | 577-580 | 1-576 | 577-580 | 1-576 |
| 5 | 576-580 | 1-575 | 576-580 | 1-575 |
| 6 | 575-580 | 1-574 | 575-580 | 1-574 |
| ••• | ••• | ••• | ••• | ••• |
| 575 | 6-580 | 1-5 | 6-580 | 1-5 |
| 576 | 5-580 | 1-4 | 5-580 | 1-4 |
| 577 | 4-580 | 1-3 | 4-580 | 1-3 |
| 578 | 3-580 | 1-2 | 3-580 | 1-2 |
| 579 | 2-580 | 1 | 2-580 | 1 |
| 580 | 1-580 | — | 1-580 | — |

As another example, the trigger point within buffer 922B may comprise a virtual point at the start or end of buffer 922B. In this regard, referring to FIG. 9, the virtual point may be a point immediately preceding buffer byte number 1 or immediately following buffer byte 2320. DAQ device 104 may identify those virtual points by data addresses 0000 and 0910, respectively.

Table 7 illustrates one-frame portions of input data, stored in buffer 922B, that can be sent to display device 108 in response to DAQ device 104 receiving input data request message 1200 with various offsets in offset field 1208 and the trigger point defined as the virtual point immediately preceding buffer byte number 1. In Table 7, as the offset increases, one less byte from frame number 1 will be in included in the one-frame portion for channel number 1 and one additional byte from frame number 3 will be included in the one-frame portion for channel number 1. A person having ordinary skill in the art will understand that Table 7 could include example offsets 7 through 574 and the byte numbers of frame numbers 1, 2, 3, and 4 that are associated with those offsets using the same pattern for using one additional byte from frame numbers 2 and 4 and one less byte from frame numbers 1 and 3 as the offset increase. In Table 7, the symbols "●●●" represent the offsets 7-574 and associated byte numbers.

TABLE 7

| | Channel No. 1 | | Channel No. 2 | |
|---|---|---|---|---|
| Off-set | Bytes Numbers from Frame No. 1 | Bytes Numbers from Frame No. 3 | Bytes Numbers from Frame No. 2 | Bytes Numbers from Frame No. 4 |
| 0 | 1-580 | — | 1-580 | — |
| 1 | 2-580 | 1 | 2-580 | 1 |
| 2 | 3-580 | 1-2 | 3-580 | 1-2 |
| 3 | 4-580 | 1-3 | 4-580 | 1-3 |
| 4 | 5-580 | 1-4 | 5-580 | 1-4 |
| 5 | 6-580 | 1-5 | 6-580 | 1-5 |
| 6 | 7-580 | 1-6 | 7-580 | 1-6 |
| ••• | ••• | ••• | ••• | ••• |
| 575 | 576-580 | 1-575 | 576-580 | 1-575 |

TABLE 7-continued

| | Channel No. 1 | | Channel No. 2 | |
|---|---|---|---|---|
| Off-set | Bytes Numbers from Frame No. 1 | Bytes Numbers from Frame No. 3 | Bytes Numbers from Frame No. 2 | Bytes Numbers from Frame No. 4 |
| 576 | 577-580 | 1-576 | 577-580 | 1-576 |
| 577 | 578-580 | 1-577 | 578-580 | 1-577 |
| 578 | 579-580 | 1-578 | 579-580 | 1-578 |
| 579 | 580 | 1-579 | 580 | 1-579 |
| 580 | — | 1-580 | — | 1-580 |

Continuing at FIG. 12, pause, previous, or next field 1210 may comprise data that identifies additional information about the data the user of display device 108 wants to view. For example, field 1210 may include information that identifies "Pause." In response to receiving the pause information, buffers 922A and 922B may stop receiving live input data or continue to not receive live input data. As another example, while historical input data is being viewed on display 300, the field 1210 may include information that identifies "previous." In response to receiving the "previous" information, buffer 922B may receive from buffer 922A two frames of input data generated immediately prior to the input data currently stored in buffer 922B, and a one frame portion of those two frames of data can be sent to display device 108 for display via display 300. As yet another example, while historical input data is being viewed on display 300, the field 1210 may include information that identifies "next." In response to receiving the "next" information, buffer 922B may receive from buffer 922A two frames of input data generated immediately after the input data currently stored in buffer 922B, and a one frame portion of those two frames of data can be sent to display device 108 for display via display 300.

In an embodiment in which DAQ device 104 includes multiple input channels, channel number field 1212 may identify numbers associate with the multiple input channels. For example, if DAQ device 104 includes 2 input channels, data within channel number field 1212 may identify channel number 1, channel number 2, or channel numbers 1 and 2. DAQ device 104 may be arranged to send display device 108 with input data generated from input signals received at the channel numbers identified in channel number field 1212.

Frame quantity field 1214 may include data that identifies how many frames of input data are being requested by display device 108. In accordance with an example embodiment, if frame quality field 1214 indicates 1 frame, that frame of data may be transmitted to display device 108 from buffer 922A or 922C. Alternatively, if frame quantity field 1214 indicates a number of frames greater than 1, then the requested frames of data are transmitted to display device from buffer 922C.

Figure 13:
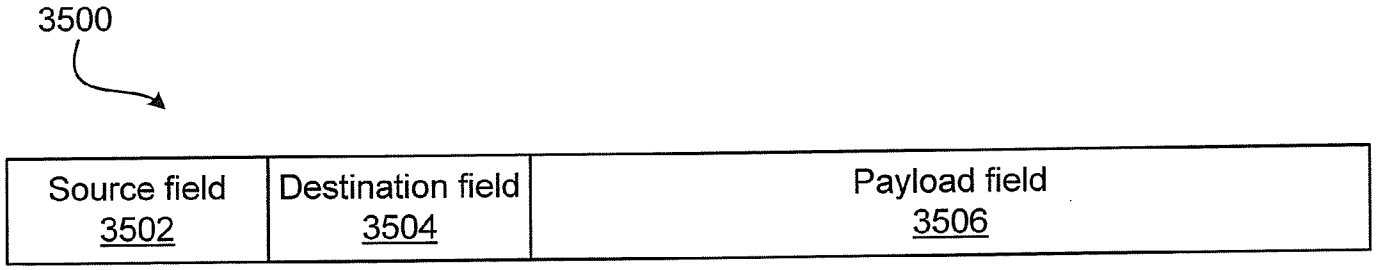

FIG. 13 illustrates an example data-share message 3500 for sharing data obtained by and/or stored at DAQ device 104, vehicle scanner 106, or display device 108 with another one or more of those devices. Data-share message 3500 may comprise a source field 3502, a destination field 3504, and a payload field 3506. Source field 3502 may include an identifier of a device that generates and/or that transmits data-share message 3500 (e.g., DAQ device 104, vehicle scanner 106, or display device 108). Destination field 3504 may include an identifier of a device that is the destination for data-share message 3500 (e.g., DAQ device 104, vehicle scanner 106, or display device 108) or identifiers of a plurality of devices that are the destinations for data-share message 3500 (e.g., two of DAQ device 104, vehicle scanner 106, and display device 108). Payload field 3506 may comprise the data obtained by and/or stored at the device that generates data-share message 3500. As an example, payload field 3506 may include instruction data 218, input data 922, or instruction data 924. As another example, payload field 3506 may include data received at wired interface 1606 from device-under-service 102.

Figure 14:
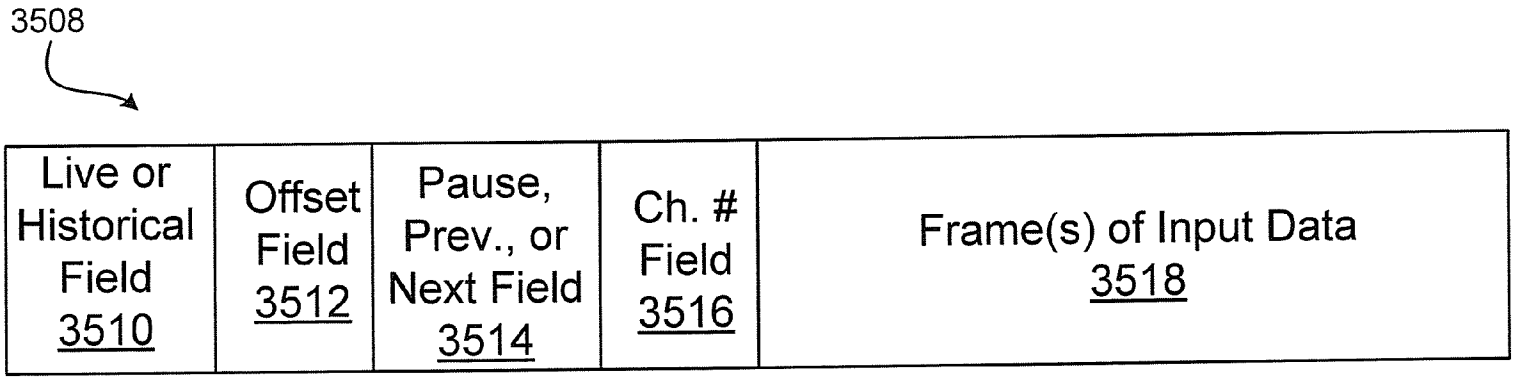

FIG. 14 illustrates example contents 3508 of payload field 3506 for a data-share message 3500 to be transmitted from DAQ device 104 to display device 108. As illustrated in FIG. 14, example contents 3506 comprises a live or historical data field 3510, an offset field 3512, a pause, previous, or next field 3514, a channel number field 3516, and frame(s) of input data 3518. For a data-share message 3500 being sent from DAQ device 104 to display device 108, the frame(s) of input data 3518 may include, for each input channel identified in channel number field 3516, a respective one frame portion of input data stored in buffer 922B or 922C. Field 3510 may include information that identifies the frame(s) of input data 3518 as being live or historical input data. Offset field 3512 may correspond to the offset field 1208 sent when requesting the input data. Field 3514 may include information that identifies whether the frame(s) of input data 3518 are previous frame(s) or next frame(s) or if the generation of input data at DAQ device 104 has been paused. Channel number field 3516 may include information that identifies which channel numbers are associated with the frame(s) of input data 3518.

IV. Example Operation

Figure 18:
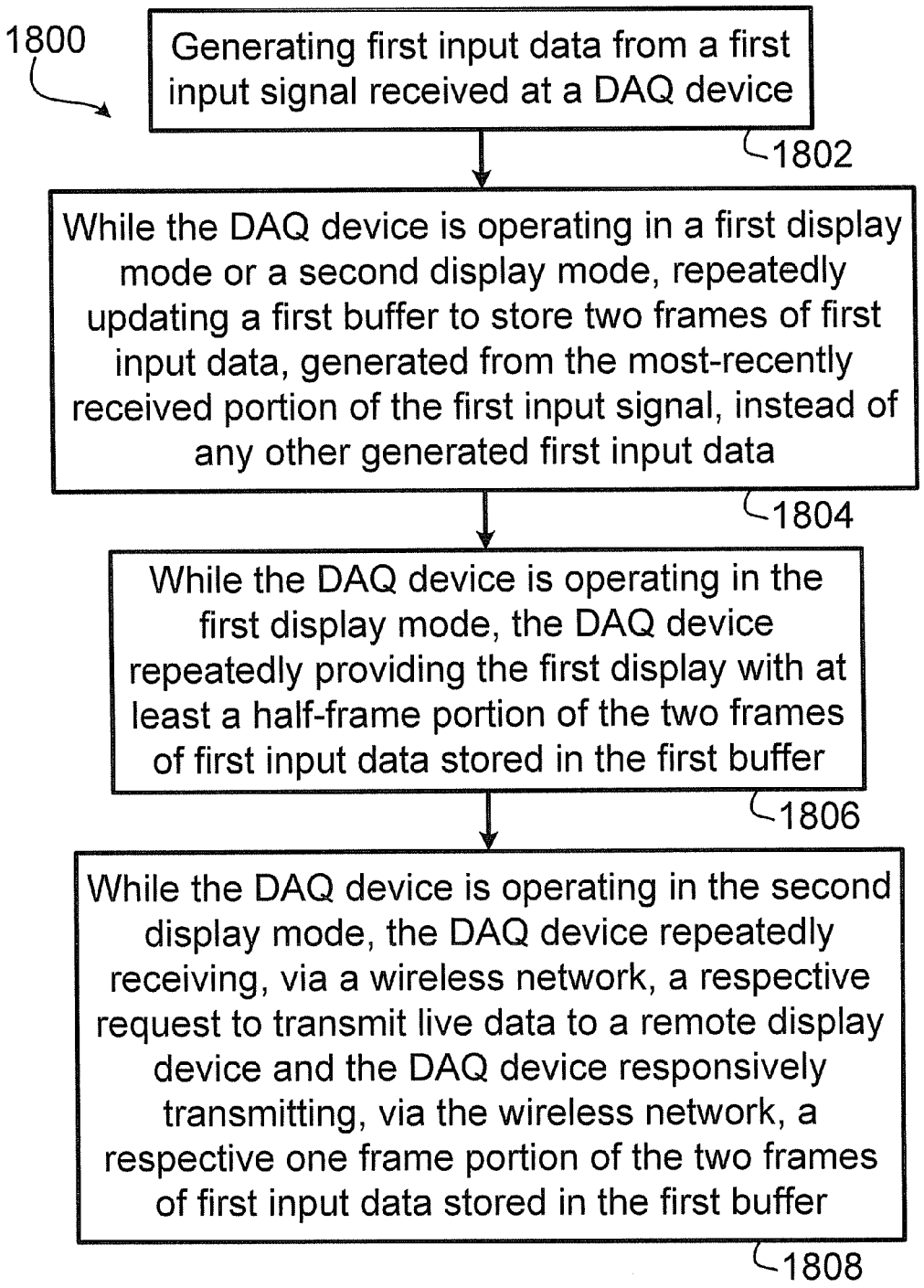
FIG. 18 is a flow chart depicting a set of functions that may be carried out in accordance with an example embodiment.

FIG. 18 depicts a flow chart that illustrates a set of functions 1800 that may be carried out in accordance with an example embodiment. The set of functions 1800 refers to a DAQ device, a remote display device, a first buffer, and a wireless network. Those elements referred to in FIG. 18 may be arranged as DAQ device 104, display device 108, buffer 922B, and wireless network 110, respectively.

Block 1802 includes generating first input data from a first input signal received at a DAQ device. Generating the first input data can include repeatedly generating input data from a respective most-recently received portion of the first input signal. The first input signal may, for example, comprise an electrical signal definable by a constant or varying voltage and current. The first input signal can be received from device-under-service 102. The first input data, upon being generated, can be stored in buffer 922B. The first input data may also be stored in buffers 922A and 922C. DAQ device 104 can operate in a variety of display modes. Those DAQ device display modes are described below.

Next, block 1804 includes, while the DAQ device is operating in a first display mode or a second display mode, repeatedly updating a first buffer to store two frames of first input data, generated from the most-recently received portion of the first input signal, instead of any other generated first input data. In this way, buffer 922B is updated to include live input data while DAQ device 104 is operating in the first or second display modes.

Next, block 1806 includes, while the DAQ device is operating in the first display mode, the DAQ device repeatedly providing the first display with at least a half-frame portion of the two frames of first input data stored in the first buffer. The at least a half-frame portion may, for example, include a quarter-frame portion of frame 1 (e.g., frame 1 data bytes numbered 436 though 580) stored in buffer 922B and a quarter-frame portion of frame 3 (e.g., frame 3 data bytes numbered 1 through 145) stored in buffer 922B. In accordance with that example, the at least a half-frame portion comprises a half-frame portion that does not exceed a half-frame portion. As another example, the at least a half-frame portion may include a half-frame portion of frame 1 stored in buffer 922B and a half-frame portion of frame 3 stored in buffer 922B. In accordance with that example, the at least a half-frame portion comprises a one frame portion that does not exceed a one frame portion.

Next, block 1808 includes, while the DAQ device is operating in the second display mode, the DAQ device repeatedly receiving, via a wireless network, a respective request to transmit live data to a remote display device and the DAQ device responsively transmitting, via the wireless network, a respective one frame portion of the two frames of first input data stored in the first buffer. The request to transmit live data can be arranged like input data request message 1200. Transmitting the first input data to display device 108 may include DAQ device 104 transferring the two frames of input data stored in buffer 922B and/or the one frame portion of the first input data stored in buffer 922B to buffer 922C and transmitting the one frame portion of the first input data stored in buffer 922C to display device 108.

The set of functions 1800 are based on a first input signal received at DAQ device 104. As described above, DAQ device 104 may include multiple input channels for receiving respective input signals. Functions similar to the set of functions 1800 can be carried out for input signals received at each of the multiple input channels. Those similar functions can be carried out at the same time that the set of functions 1800 are carried out. By way of example, the first input signal received at DAQ device 104 can be received at input channel 3600, whereas a second input signal received at DAQ device 104 can be received at input channel 3602.

The functions similar to set of functions 1800 can be based on the second input signal. Those functions may include DAQ device 104 generating second input data from the second input signal. Generating the second input data can include repeatedly generating input data from a respective most-recently received portion of the second input signal. The second input data, upon being generated, can be stored into buffer 922B.

While DAQ device 104 is operating in the first display mode or the second display mode, DAQ device 104 can repeatedly update buffer 922B to store two frames of second input data, generated from the most-recently received portion of the second input signal, instead of any other generated second input signal. In this way, buffer 922B is repeatedly refreshed with live data for input channel 3602.

While DAQ device 104 is operating in the first display mode, DAQ device 104 can repeatedly provide display 1000 with at least a half-frame portion of the two frames of second input data stored in buffer 922B. Each of those half-frame portions can be visually presented via display 1000. In one case, the at least a half-frame portion comprises a half-frame portion that does not exceed a half-frame portion. In another case, the at least a half-frame portion comprises a one frame portion that does not exceed a one frame portion.

While DAQ device 104 is operating in the second display mode, DAQ device 104 can repeatedly receive, from display device 108, requests to transmit live data to display device 108. In response to receiving each of those requests to transmit live data, wireless transceiver 902 can transmit a respective one frame portion of the two frames of second input data stored in buffer 922B or buffer 922C. Transmission of each of those one frame portions can occur via wireless network 110.

Table 8 illustrates example display modes for displaying live input data, historical input data, or live and historical data at displays 300 and 1000.

TABLE 8

| Display Mode | Display input data at local display (e.g., display 1000) | Display Input Data at Remote Display (e.g., Display 300) | Live Input Data | Historical Input Data | Pause Input Data |
|---|---|---|---|---|---|
| 1 | • | | • | | |
| 2 | | • | • | | |
| 3 | • | | | • | |
| 4 | | • | | • | |
| 5 | • | | | • | • |
| 6 | | • | | • | • |
| 7 | • | • | • | | |
| 8 | • | • | | • | |

Referring to Table 8, DAQ device 104 can operate in a third display mode (i.e., display mode 3) so as to display historical input data at display 1000. The historical input data displayed for the third display mode can comprise historical input data for one or more input channels of DAQ device 104. While operating in the third display mode, buffers 922A, 922B, and 922C may not receive live input data from ADC block 3408, however, buffer 922B can be refreshed with data from the historical input data stored in buffer 922A, and buffer 922C can be refreshed with data from buffer 922A or 922B. Each time buffer 922B is refreshed with historical input data from buffer 922A, a respective half-frame portion or one-frame portion of the input data stored in buffer 922B for one or more input channels of DAQ device 104 can be provided to display 1000.

While operating in a display mode in which buffer 922B is refreshed with input data from buffer 922A, the input data provided to buffer 922B, relative to the input data currently stored in buffer 922B, may comprise earlier generated input data (e.g., in response to a user pushing previous input data selector 1716) or later generated input data (e.g., in response to a user pushing a next input data selector 1718). If DAQ device 104 is operating in a mode in which earlier generated input data is being provided to buffer 922B, when the earliest generated input data stored in buffer 922A is reached and provided to buffer 922B, buffer 922A can wrap around to a far end of buffer 922A and continue sending earlier generated input data starting with the latest generated input data. Alternatively, if DAQ device 104 is operating in a mode in which later generated input data is being provided to buffer 922B, when the latest generated input data stored in buffer 922A is reached and provided to buffer 922B, buffer 922A can wrap around to a far end of buffer 922A and continue sending later generated input data starting with the earliest generated input data.

Referring to Table 8, DAQ device 104 can operate in a fourth display mode (i.e., display mode 4) so as to provide display device 108 with historical input data for visual presentation at display 300. The historical input data displayed for the fourth display mode can comprise historical input data for one or more input channels of DAQ device 104. While operating in the fourth display mode, buffer 922B can be refreshed with data from the historical input data stored in buffer 922A. While operating in the fourth display mode, buffers 922A, 922B, and 922C may not receive live input data from ADC block 3408. While operating in the fourth display mode, DAQ device 104 can repeatedly receive, via wireless network 110, a respective request to transmit historical data to display device 108.

In response to each request for historical input data for input channel 3600, DAQ device 104 can transmit, via wireless network 110, a respective one frame portion of the two frames of historical input data stored, for input channel 3600, in buffer 922B or buffer 922C. In response to each request for historical input data for input channel 3602, DAQ device 104 can transmit, via wireless network 110, a respective one frame portion of the two frames of historical input data stored, for input channel 3602, in buffer 922B or 922C. In response to each request for historical input data for input channels 3600 and 3602, DAQ device 104 can transmit, via wireless network 110, a respective one frame portion of the two frames of historical input data stored, for input channel 3600, in buffer 922B or buffer 922C and a respective one frame portion of the two frames of historical input data stored, for input channel 3602, in buffer 922B or 922C.

Referring to Table 8, while DAQ device 104 is operating in the third display mode (i.e., display mode 3), DAQ device 104 may receive a user input via user interface 900 and responsively cause DAQ device 104 to transition from operating in the third display mode to operating in a fifth display mode (i.e., display mode 5). The user input may be received in response to a user pressing pause selector 1708. While operating in the fifth display mode, as an example, display 1000 may repeatedly display (i) a half-frame portion of historical first input data stored in buffer 922B, (ii) a half-frame portion of historical second input data stored in buffer 922B, or (iii) a half-frame portion of historical first input data stored in buffer 922B and a half-frame portion of historical second input data stored in 922B. Each of those half-frame portions of historical data may comprise a quarter-frame of data immediately prior to the trigger point in buffer 922B and a quarter frame of data immediately after the trigger point in buffer 922B. Alternatively, in display mode 5, the display 1000 may repeatedly display one-frame portions from buffer 922B instead of the half-frame portions described above.

Referring to Table 8, while DAQ device 104 is operating in the fourth display mode (i.e., display mode 4), DAQ device 104 may receive a user input via user interface 900 and responsively cause DAQ device 104 to transition from operating in the fourth display mode to operating in a sixth display mode (i.e., display mode 6). The user input may be received in response to a user pressing pause selector 1708. While operating in the sixth display mode, as an example, display 300 may repeatedly display (i) a one-frame portion of historical first input data stored in buffer 922C, (ii) a one-frame portion of historical second input data stored in buffer 922C, or (iii) a one-frame portion of historical first input data stored in buffer 922C and a one-frame portion of historical second input data stored in 922C. Each of those one-frame portions of historical data may comprise a half-frame of data immediately prior to a trigger point in buffer 922C and a half frame of data immediately after the trigger point in buffer 922C.

Referring to Table 8, DAQ device 104 can operate in a seventh display mode (i.e., display mode 7) so as to display live input data at display 300 and display 1000. While operating in the seventh display mode, DAQ device 104 can display live input data to display 300 in the same manner as it is displayed for display mode 1 and provide live input data to display device 108 in the same manner as it is provided for display mode 2.

Referring to Table 8, DAQ device 104 can operate in an eighth display mode (i.e., display mode 8) so as to display historical input data at display 300 and display 1000. While operating in the eighth display mode, DAQ device 104 can display historical input data to display 300 in the same manner as it is displayed for display mode 3 and provide historical input data to display device 108 in the same manner as it is provided for display mode 4.

V. Conclusion

Example embodiments have been described above. Those skilled in the art will understand that changes and modifications may be made to the described embodiments without departing from the true scope and spirit of the present invention, which is defined by the claims.

We claim:

1. A method comprising:

generating first input data from a first input signal received at a data acquisition (DAQ) device, wherein generating the first input data comprises repeatedly generating input data from a respective most-recently received portion of the first input signal, wherein the DAQ device comprises a first buffer that is operable to store two frames of the first input data, wherein the DAQ device comprises a first display for displaying at least a half-frame of the first input data, and wherein the DAQ device is operable in a first display mode and in a second display mode;

wherein, while the DAQ device is operating in the first display mode or the second display mode, repeatedly updating the first buffer to store two frames of first input data, generated from the most-recently received portion of the first input signal, instead of any other generated first input data;

wherein, while the DAQ device is operating in the first display mode, the DAQ device repeatedly providing the first display with at least a half-frame portion of the two frames of first input data stored in the first buffer; and wherein, while the DAQ device is operating in the second display mode, the DAQ device repeatedly receiving, via a wireless network, a respective request to transmit live data to a remote display device and the DAQ device responsively transmitting, via the wireless network, a respective one frame portion of the two frames of first input data stored in the first buffer.

2. The method of claim 1, further comprising:

generating second input data from a second input signal received at the DAQ device, wherein generating the second input data comprises repeatedly generating input data from a respective most-recently received portion of the second input signal, wherein the first buffer is operable to store two frames of the second input data, and wherein the first display is operable to display at least a half-frame of the second input data;

wherein, while the DAQ device is operating in the first display mode or the second display mode, repeatedly updating the first buffer to store two frames of second input data, generated from the most-recently received portion of the second input signal, instead of any other generated second input data;

wherein, while the DAQ device is operating in the first display mode, the DAQ device repeatedly providing the first display with at least a half-frame portion of the two frames of second input data stored in the first buffer; and wherein, while the DAQ device is operating in the second display mode, in response to the DAQ device repeatedly receiving, via a wireless network, the respective request to transmit live data to the remote display device, the DAQ device transmitting, via the wireless network, a respective one frame portion of the two frames of second input data stored in the first buffer.

3. The method of claim 2, wherein the first input signal received at the DAQ device is received at a first input channel of the DAQ device and wherein the second input signal received at the DAQ device is received at a second input channel of the DAQ device.

4. The method of claim 2, wherein each frame of the first input data comprises a given number of data bytes, wherein each frame of the second input data comprises the given number of data bytes, wherein each half-frame portion of the two frames of first input data stored in the first buffer comprises one half the given number of data bytes, wherein each one frame portion of the two frames of first input data and each one frame portion of the two frames of second input data comprise the given number of data bytes.

5. The method of claim 4, wherein the given number of data bytes is 580 data bytes.

6. The method of claim 2, wherein a given two frames of first input data stored in the first buffer comprise a first frame of input data and a second frame of input data, wherein a given two frames of second input data, stored in the first buffer at the same time the given two frames of first input data are stored in the first buffer, comprise a third frame of input data and a fourth frame of input data, wherein the second frame of input data and the fourth frame of input data follow the first frame of input data and the third frame of input data, wherein the first buffer comprises a trigger point located after a last byte of the first frame of input data and a last byte of the third frame of input data and prior to a first byte of the second frame of input data and a first byte of the fourth frame of input data, wherein, when the given two frames of first input data are stored in the first buffer, providing the first display with the at least a half-frame portion of the two frames of first input data comprises providing the first display with a quarter-frame portion of the first frame of input data closest to the trigger point and a quarter-frame portion of the second frame of input data closest to the trigger point, and wherein, when the given two frames of second input data are stored in the first buffer, providing the first display with the at least a half-frame portion of the two frames of second input data comprises providing the first display with a quarter-frame portion of the third frame of input data closest to the trigger point and a quarter-frame portion of the fourth frame of input data closest to the trigger point.

7. The method of claim 6, wherein the first frame of input data is interleaved with the third frame of input data and the second frame of input data is interleaved with the fourth frame of input data.

8. The method of claim 2, wherein each at least a half-frame portion of the two frames of first input data stored in the first buffer does not exceed one half frame of the first input data, and wherein each at least a half-frame portion of the two frames of second input data stored in the first buffer does not exceed one half-frame of the second input data.

9. The method of claim 1, wherein the DAQ device comprises a second buffer for storing historical first input data, wherein the historical first input data comprises the first input data generated from portions of the first input signal received at the DAQ device prior to the most-recently received portion of the first input signal, wherein the DAQ device is operable in a third display mode and in a fourth display mode, wherein, while the DAQ device is operating in the third display mode and the fourth display mode, repeatedly updating the first buffer to store two frames of the historical first input data stored in the second buffer instead of any other generated first input data, wherein, while the DAQ device is operating in the third display mode, the DAQ device repeatedly providing the first display with at least a half-frame portion of the two frames of historical first input data stored in the first buffer, wherein, while the DAQ device is operating in the fourth display mode, in response to the DAQ device repeatedly receiving, via the wireless network, a respective request to transmit historical data to the remote display device and the DAQ device responsively transmitting, via the wireless network, a respective one frame portion of the two frames of historical first input data stored in the first buffer, wherein, at any given time, the DAQ device operates in only one of the first display mode, the second display mode, the third display mode, and the fourth display mode.

10. The method of claim 9, wherein the second buffer is operable to store historical second input data, wherein the historical second input data comprises the second input data generated from portions of the second input signal received at the DAQ device prior to the most-recently received portion of the second input signal, wherein, while the DAQ device is operating in the third display mode and the fourth display mode, repeatedly updating the first buffer to store two frames of the historical second input data stored in the second buffer instead of any other generated second input data, wherein, while the DAQ device is operating in the third display mode, the DAQ device repeatedly providing the first display with at least a half-frame portion of the two frames of historical second input data stored in the first buffer, and wherein, while the DAQ device is operating in the fourth display mode, in response to the DAQ device repeatedly receiving, via the wireless network, the respective request to transmit historical data to the remote display device and the DAQ device responsively transmitting, via the wireless network, a respective one frame portion of the two frames of historical second input data stored in the first buffer.

11. The method of claim 10, further comprising:

the DAQ device receiving a first user input entered via a user interface of the DAQ device and responsively causing the DAQ device to operate in a fifth display mode, wherein operating in the fifth display mode comprises repeatedly displaying at least a half-frame portion of the historical first input data stored in the first buffer and at least a half-frame portion of the historical second input data stored in the first buffer.

12. A data acquisition (DAQ) device comprising:

one or more input channels operable to receive input signals from a device-under-service;

a first buffer operable to store more than two frames of historical input data generated from the input signals received at the one or more input channels;

a second buffer operable to store, for each input channel of the one or more input channels, two frames of live input data generated at the DAQ device or two frames of historical input data stored in the first buffer;

a first display operable to visually present input data generated at the DAQ device, wherein, when the first display visually presents the input data, the first display visually presents, for one or more input channels of the DAQ device, at least a half-frame portion of the input data stored in the second buffer; and a wireless transceiver operable to receive a request for input data, wherein the request for input data is transmitted to the wireless transceiver from a display device comprising a second display operable to visually present input data generated at the DAQ device, and wherein the wireless transceiver is operable to transmit, to the display device, a respective one-frame portion of input data for one or more of the input channels of the DAQ device.

13. The DAQ device of claim 12, further comprising:

a third buffer operable to store the respective one-frame portions of input data for the one or more of the input channels of the DAQ device prior to transmission of the respective one-frame portions of input data to the display device.

14. The DAQ device of claim 12, wherein the live input data or the historical input data stored in the first buffer is interleaved.

15. The DAQ device of claim 12, wherein first frames of the live input data or the historical input data are stored in a first portion of the first buffer, wherein second frames of the live input data or the historical input data are stored in a second portion of the first buffer, wherein a point within the first buffer is designated as a trigger point that identifies starting point of each respective one-frame portion of input data, and wherein the request for input data comprises an offset to adjust the designated trigger point.

16. The DAQ device of claim 15, wherein the point within the first buffer comprises a point between the first portion of the first buffer and the second portion of the first buffer.

17. The DAQ device of claim 12, wherein the request for the input data comprises a field that identifies historical input data is being requested, wherein, in response to historical input data being requested, two frames of historical data from the second buffer are stored into the first buffer and a one-frame portion of the historical data stored in the first buffer is provided to the wireless transceiver for transmission to the display device.

18. The DAQ device of claim 12, wherein, while the first buffer contains two given frames of historical input data for each input channel of the DAQ device, the wireless transceiver is operable to receive another request for input data, wherein the other request for input data is transmitted to the wireless transceiver from the display device, wherein the other request for input data comprises a request for previous historical input data or next historical input data, wherein if the other request comprise a request for previous historical input data, the first buffer receives from the second buffer two frames of historical input data generated for each input channel of the DAQ device prior to generation of the two given frames of historical input data for each input channel, and the wireless transceiver transmits, to the display device, a respective one-frame portion of the historical input data generated for each input channel of the DAQ device prior to generation of the two given frames of historical input data for each input channel, and wherein if the other request comprises a request for next historical input data, the first buffer receives from the second buffer two frames of historical input data generated for each input channel of the DAQ device immediately after generation of the two given frames of historical input data for each input channel, and the wireless transceiver transmits, to the display device, a respective one-frame portion of the historical input data generated for each input channel of the DAQ device immediately after generation of the two given frames of historical input data for each input channel.

19. A display system comprising:

a display device operable to visually present input data;

a wireless transceiver operable to transmit from the display device a request for the input data to a data acquisition (DAQ) device via a wireless network, wherein the wireless transceiver is operable to receive the input data from the DAQ device via the wireless network; and a user interface operable to receive a selection of whether the requested input data is live input data or historical input data, wherein, when the display device operates to visually present the input data, the display device visually presents one frame of input data for one or more input channels at the DAQ device, and wherein, when the DAQ device operates to visually present input data, a display at the DAQ device visually presents at least a half frame of input data for one or more of the input channels at the DAQ device.

20. The display system of claim 19, wherein the request for the input data identifies an offset for determining which one or more one-frame portions of a buffer at the DAQ device is to be transmitted to the display device in response to the request for the input data, and wherein the buffer comprises storage capacity for storing two frames of input data for each of the one or more input channels at the DAQ device.

21. The display system of claim 20, wherein, if the selection of whether the input data is live input data or historical data comprises a selection of historical input data, the user interface is further operable to receive a selection to request a previous frame of historical input data or a next frame of historical input data, and wherein the request for input data further comprises data identifying the selection to request a previous frame of historical input data or a next frame of historical input data.

22. The display system of claim 19, wherein the at least a half frame of input data visually presented via the display at the DAQ device does not exceed one half frame of the input data.

23. The display system of claim 19, wherein the request for the input data comprises a single request for multiple frames of data from a particular input channel of the one or more input channels at the DAQ device, wherein the input data received by the wireless transceiver comprises the multiple frames of data from the particular input channel, and wherein the display device further comprises:

a processor; and a non-transitory computer-readable data storage device comprising computer-readable program instructions executable by the processor to compress the received multiple frames of data from the particular input channel into one frame of input data for the particular input channel to be displayed via the display device.

24. The display system of claim 19, wherein the received multiple frames of data are stored within the data storage device, wherein the processor is operable to execute the computer-readable program instructions to compress at least a portion of the multiple frames of data stored within the data storage device at multiple zoom levels ranging from 2 frames to a quantity of the multiple received frames, and wherein the compressed frames for each of the multiple zoom levels are displayed as one frame on the display device.

* * * * *